US009174449B2

(12) United States Patent
Nakamura et al.

(10) Patent No.: US 9,174,449 B2
(45) Date of Patent: Nov. 3, 2015

(54) WIPER CASSETTE, WIPER UNIT AND LIQUID EJECTING APPARATUS

(71) Applicant: SEIKO EPSON CORPORATION, Tokyo (JP)

(72) Inventors: Chikashi Nakamura, Azumino (JP); Keiji Matsumoto, Matsumoto (JP); Toshihiko Wakabayashi, Shiojiri (JP); Jun Ushiama, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/163,878

(22) Filed: Jan. 24, 2014

(65) Prior Publication Data

US 2014/0139588 A1 May 22, 2014

Related U.S. Application Data

(63) Continuation of application No. 13/669,852, filed on Nov. 6, 2012, now Pat. No. 8,672,447.

(30) Foreign Application Priority Data

| | | |
|---|---|---|
| Nov. 11, 2011 | (JP) | 2011-247659 |
| Nov. 11, 2011 | (JP) | 2011-247660 |
| Nov. 11, 2011 | (JP) | 2011-247661 |
| Nov. 11, 2011 | (JP) | 2011-247662 |

(51) Int. Cl.
*B41J 23/00* (2006.01)
*B41J 2/165* (2006.01)

(52) U.S. Cl.
CPC ..... *B41J 2/16535* (2013.01); *B41J 2/16552* (2013.01); *B41J 2/16585* (2013.01)

(58) Field of Classification Search
CPC ..... B41J 2/16535; B41J 2/16552; B41J 2/16544; B41J 2002/16558
USPC ..... 347/33
See application file for complete search history.

(56) References Cited

U.S. PATENT DOCUMENTS

| | | | | |
|---|---|---|---|---|
| 4,223,322 | A | 9/1980 | van Raamsdonk | |
| 4,402,599 | A | 9/1983 | Seto | |
| 5,831,644 | A | 11/1998 | Kato | |
| 6,648,449 | B2 * | 11/2003 | Gonzalez | 347/33 |
| 2006/0187289 | A1 | 8/2006 | Nakashima | |
| 2011/0261130 | A1 * | 10/2011 | Hirai et al. | 347/104 |

FOREIGN PATENT DOCUMENTS

| | | |
|---|---|---|
| EP | 1350627 | 10/2003 |
| JP | 11-115198 | 4/1999 |
| JP | 2002-321419 | 11/2002 |
| JP | 2005-111808 | 4/2005 |
| JP | 2005-212351 | 8/2005 |
| JP | 2005212351 A * | 8/2005 |
| JP | 2006-225129 | 8/2006 |
| JP | 2010-221563 | 10/2010 |
| JP | 2011-126129 | 6/2011 |

* cited by examiner

*Primary Examiner* — Alessandro Amari
*Assistant Examiner* — Michael Konczal
(74) *Attorney, Agent, or Firm* — Workman Nydegger

(57) ABSTRACT

Ratchets which regulate a rotation of either a reeling-out roller around which one end of a long wiping member which wipes ink attached to a recording head which ejects ink is wound, or a winding-up roller around which the other end of the wiping member is wound to which tension is applied due to a friction force which acts on the wiping member when performing wiping are provided.

15 Claims, 21 Drawing Sheets

WIPER CASSETTE, WIPER UNIT AND LIQUID EJECTING APPARATUS

CROSS REFERENCES TO RELATED APPLICATIONS

This application is a Continuation of U.S. patent application Ser. No. 13/669,852 filed Nov. 6, 2012 (which patent application is incorporated herein by reference in its entirety), which claims the benefit of 1) Japanese Patent Application No. 2011-247659, filed Nov. 11, 2011 (which is also expressly incorporated herein by reference in its entirety), Japanese Patent Application No. 2011-247660, filed Nov. 11, 2011 (which is also expressly incorporated herein by reference in its entirety), Japanese Patent Application No. 2011-247661, filed Nov. 11, 2011 (which is also expressly incorporated herein by reference in its entirety), and Japanese Patent Application No. 2011-247662, filed Nov. 11, 2011 (which is also expressly incorporated herein by reference in its entirety).

BACKGROUND

1. Technical Field

The present invention relates to a wiper unit which wipes a liquid ejecting head, and a liquid ejecting apparatus which includes the wiper unit.

2. Related Art

In the related art, an ink jet printer which forms an image by ejecting liquid from a liquid ejecting head onto a recording medium such as a sheet of paper has been known as a type of liquid ejecting apparatus. In such a printer, usually, a head maintenance unit for maintaining an ejecting property of liquid from the liquid ejecting head is provided.

For example, in a printer which is disclosed in JP-A-2011-126129, as such a head maintenance unit, cleaning means which wipes liquid attached to a liquid ejecting head is provided. The cleaning means includes a carriage which moves according to a driving force which is transmitted from a first motor, a first reel which is rotatably provided on the side surface of the carriage, and a second reel which is provided on the surface on which the first reel is provided, and is rotatably driven according to a driving force which is transmitted from a second motor. In addition, a long cleaning tape (wiping member) is stretched between the first reel and the second reel. Specifically, an unused portion of the cleaning tape is wound around the first reel, and a used portion of the cleaning tape is wound around the second reel.

In addition, liquid is wiped from the liquid ejecting head by moving the carriage according to the driving force which is transmitted from the first motor to the feed direction while feeding the cleaning tape from the first reel to the second reel by rotatably driving the second reel according to the driving force which is transmitted from the second motor in a state in which the cleaning tape is in contact with the liquid ejecting head.

Meanwhile, in the above described printer, the cleaning tape is prevented from sagging due to sliding contact with the liquid ejecting head by moving the carriage in the sending direction while sending the cleaning tape which is caused to come into contact with the liquid ejecting head from the first reel to the second reel. For this reason, when sagging of the cleaning tape is suppressed, it is essential to provide a second motor for winding the cleaning tape around the second reel, accordingly, there have been problems in that the weight of the carriage is increased by the weight of the second motor, and the driving load of the first motor when moving the carriage is increased.

SUMMARY

An advantage of some aspects of the invention is to provide a wiper unit and a liquid ejecting apparatus which are lightweight, and in which a wiping member is prevented from sagging when wiping liquid from a liquid ejecting head.

According to an aspect of the invention, there is provided a wiper unit which includes a wiper holder which rotatably supports a first roller around which one end of a long wiping member for wiping liquid which is attached to a liquid ejecting head for ejecting the liquid is wound, and a second roller around which the other end of the wiping member is wound, and moves a portion of the wiping member which is stretched between the first roller and the second roller in a wiping direction in which the liquid is wiped from the liquid ejecting head in a state of being in contact with the liquid ejecting head, and a regulation member which regulates rotation of either the first roller, or the second roller to which tension is applied due to a friction force which acts with respect to the wiping member when performing the wiping.

According to the above described configuration, when wiping liquid by making the wiping member coming into contact with the liquid ejecting head, a rotation of a roller in the direction in which the wiping member is reeled out is regulated even when tension acts on the wiping member in the direction in which the wiping member is reeled out due to a friction force which is generated between the liquid ejecting head and the wiping member. In addition, the regulation member which regulates the rotation of the roller can be configured in lightweight compared to a drive motor which is used when rotationally driving both the rollers. For this reason, it is possible to make a more lightweight wiper holder compared to a case in which the drive motor which rotationally drives both rollers is provided in the wiper holder. Accordingly, it is possible to prevent the wiping member from sagging when wiping liquid from the liquid ejecting head while making the wiper holder more lightweight.

In the wiper unit, a transmission gear which transmits a rotation power of a roller to which the tension is applied may be included, and the regulation member may include a ratchet which suppresses rotation of the roller to which the tension is applied when performing the wiping by being engaged with the transmission gear.

According to the above described configuration, when the ratchet is engaged with the transmission gear, it is possible to suppress sagging of the wiping member when wiping liquid from the liquid ejecting head by suppressing the rotation of the roller to which tension is applied when performing wiping.

In the wiper unit, a regulation releasing member which releases engagement of the ratchet with respect to the transmission gear is further included.

According to the above described configuration, it is possible to wind the wiping member around the roller when the regulation releasing member releases the regulation of rotation with respect to the roller due to the ratchet. Accordingly, it is possible to wind the wiping member around the roller as necessary when not performing wiping, while suppressing sagging of the wiping member when wiping liquid from the liquid ejecting head.

In the wiper unit, the ratchet is bent in the direction in which the regulation releasing member comes into contact with the ratchet, and the engagement with the transmission gear is released along with movement of the ratchet when performing wiping, and is engaged with the transmission gear when the regulation releasing member does not come into contact therewith.

According to the above described configuration, the regulation releasing member releases the regulation of rotation with respect to the roller due to the ratchet, along with movement of the ratchet when performing wiping. For this reason, it is not necessary to perform a special operation for releasing the regulation of rotation with respect to the roller due to the ratchet, and it is possible to wind the wiping member around the roller as necessary when not performing wiping.

According to another aspect of the invention, there is provided a liquid ejecting apparatus which includes a liquid ejecting head, and a wiper unit having the above configuration.

According to the above configuration, it is possible to obtain the same effect as the aspect of the invention of the wiper unit.

Meanwhile, in the printer, it is preferable to prevent a contaminated used portion on the cleaning tape from coming into contact with the liquid ejecting head in order to prevent liquid which is once trapped on the cleaning tape when performing wiping from spreading to other portions of the liquid ejecting head. In addition, in order to do that, a configuration is considered in which an operation of wiping liquid from the liquid ejecting head using the cleaning tape, and an operation of winding the cleaning tape around the second reel by a given amount are alternately executed.

However, in the above printer, there is a difference in the winding amount of the cleaning tape when the second reel is rotated by a given amount (that is, amount of given rotation) depending on the size of the roll diameter of the cleaning tape which is wound around the second reel. For this reason, the cleaning tape of the same length is not necessarily wound around the second reel, even when the second reel is rotated by a given amount by the second motor. For example, if the roll diameter of the cleaning tape which is wound around the second reel is large, and when the second reel is rotated by a given amount, since the length of the cleaning tape which is wound around the second reel becomes longer than the desired length, there has been a concern that the cleaning tape may be wastefully consumed. On the other hand, there is concern that an used portion on the cleaning tape may come into contact with the liquid ejecting head if the roll diameter of the cleaning tape which is wound around the second reel is small, and when the second reel is rotated by a given amount, since the length of the cleaning tape which is wound around the second reel becomes shorter than the desired length, there has been a concern that the cleaning tape may be wastefully consumed.

Therefore, the wiper unit according to the aspect of the invention, there is provided a wiper unit which includes a first roller around which a long wiping member which wipes the liquid attached to a liquid ejecting head which ejects liquid is wound, a second roller which winds up the wiping member which is reeled out from the first roller, a winding-up roller which rotationally moves so as to rotate along with reeling out of the wiping member from the first roller to the second roller in a state where a stretched portion of the wiping member between the first roller to the second roller is wound up, and a rotation amount detection member which detects a rotation amount of the winding-up roller.

According to the above configuration, the rotation amount detection member detects a reeling-out amount of the wiping member from the first roller to the second roller which is wound around the winding-up roller through a detection of a rotation amount of the winding-up roller. For this reason, it is possible to accurately detect the reeling-out amount of the wiping member from the first roller to the second roller without being affected by the sizes of the roll diameters of the wiping members which are wound around both the rollers. Accordingly, it is possible to prevent a portion of the wiping member in which liquid is absorbed from attaching to the liquid ejecting head while suppressing waste of the wiping member.

In addition, in the wiper unit according to the aspect of the invention, the rotation amount detection member is provided with respect to a wiper holder in which a wiper cassette which rotatably supports each unit is detachably mounted.

According to the above configuration, since rotation amount detection member is provided with respect to the wiper holder from which the wiper cassette is detached, a common rotation amount detection member can be used with respect to wiper cassettes before and after attaching and detaching. That is, since it is not necessary to provide the rotation amount detection member for each detached wiper cassette, it is possible to contribute to a reduction in the number of components.

In addition, the wiper unit according to the aspect of the invention further includes a holding roller which interposes the wiping member between the holding roller and the winding-up roller.

According to the above configuration, the wiping member is interposed between the holding roller and the winding-up roller. For this reason, the winding-up roller which is interposing the wiping member is more stably rotationally moved so as to rotate along with the reeling out of the wiping member from the first roller to the second roller. Accordingly, the rotation amount detection member is able to accurately detect the reeling-out amount of the wiping member through detection of the rotation amount of the winding-up roller.

In addition, the wiper unit according to the aspect of the invention further includes an urging member which urges the holding roller in the direction in which the holding roller is caused to approach the winding-up roller.

According to the above configuration, the wiping member is tightly interposed between the winding-up roller and the holding roller based on an urging force which acts from the urging member to the holding roller. For this reason, a slip of the wiping member with respect to the winding-up roller in the reeling-out direction of the wiping member is suppressed. Accordingly, a rotation amount detection unit can more accurately detect the rotation amount of the winding-up roller as the reeling-out amount of the wiping member.

Meanwhile, in the above described printer, there has been a problem in that detaching and replacing of the cassette cannot be easily performed, since the cassette is mounted in a fitted state with respect to the main body of the unit.

Therefore, the wiper unit according to the aspect of the invention includes the wiper cassette in which the wiping member which wipes liquid which is attached to the liquid ejecting head ejecting the liquid, and the wiper unit which is configured to be able to mount the wiper cassette detachably, and in a fitted state, and is movable in the wiping direction in which the liquid is wiped from the liquid ejecting head in a state in which the wiping member is in contact with the liquid ejecting head. The wiper cassette includes a power point action unit which is provided so as to extend in the direction which intersects the detaching direction from the wiper holder, a protrusion which protrudes in the detaching direction, and the direction intersecting the direction in which the power point action unit is extended, and a locking hook which fixes the wiper holder in a mounted state. The wiper holder includes an engagement unit which guides the protrusion in the detaching direction, and a hole which is locked with the locking hook, and the protrusion is located between the power point action unit and the locking hook in the direction intersecting the detaching direction and the protruding direction of the protrusion.

According to the above configuration, when the wiping member which is mounted in the wiper cassette wipes the liquid ejecting head, a displacement of the wiper cassette is regulated by the locking hook even when the wiper cassette is to be displaced in the detaching direction from the wiper holder due to a reaction force which is caused from the liquid ejecting head. On the other hand, when the wiper cassette is detached from the wiper holder, fixing with respect to the wiper holder due to the locking hook is released when the wiper cassette is tilted using the protrusion as the center of tilting. For this reason, a detaching operation of the wiper holder from the wiper cassette is not hindered by the locking hook. Accordingly, it is possible to easily detach the wiper cassette from the wiper holder.

In addition, in the wiper unit according to the aspect of the invention, the protrusion is located between the power point action unit and the locking hook in the detaching direction.

According to the above configuration, when the wiper cassette is detached from the wiper holder, if the wiper cassette is tilted using the protrusion as the center of tilting, the fixing with respect to the wiper holder due to the locking hook is further reliably released. Accordingly, it is possible to further easily detach the wiper cassette from the wiper holder.

Meanwhile, in the above described printer, since a drive motor which is driven in order to move the carriage, and a drive motor which is driven for winding the cleaning tape around the second reel are separately provided, there are problems in that the number of components are increased, and an efficiency in assembling a head maintenance unit is decreased.

Therefore, the wiper unit according to the aspect of the invention includes a wiper holder which rotatably supports a roller around which a wiping member which wipes liquid attached to a liquid ejecting head which ejects liquid is wound, and moves the wiping member from the liquid ejecting head to a wiping direction in which the liquid is wiped in a state where the wiping member is in contact with the liquid ejecting head, and a driving mechanism which moves the wiper holder in the wiping direction, in which the driving mechanism includes a drive gear which is rotationally driving based on a power which is transmitted from a drive motor, a displacement gear which is displaceable in a circumferential direction of the drive gear in a state of being engaged with the drive gear, and a power transmission gear which transmits a rotational power to the roller, and in which the displacement gear winds the wiping member by being engaged with the power transmission gear, and rotating the roller by being released from an engagement with an engaged portion after being engaged with the engaged portion of the wiper holder, and moving the wiper holder in the wiping direction.

According to the above described configuration, when the drive gear is rotatably driven based on a power which is transmitted from the drive motor in a state in which the displacement gear is engaged with the engaged portion of the wiper holder, the wiper holder is moved in the wiping direction in which the wiper holder wipes the liquid ejecting apparatus when a rotational driving force is transmitted to the engaged portion of the wiper holder through the displacement gear. On the other hand, when the drive gear is rotationally driven based on the power which is transmitted from the drive motor in a state in which the displacement gear is engaged with the power transmission gear, the wiping member is wound around the roller when the rotational driving force is transmitted to the power transmission gear through the displacement gear. That is, the drive motor not only functions as a driving source when moving the wiper holder in the wiping direction, but also functions as a driving source when winding the wiping member around the roller.

In the wiper unit according to the aspect of the invention, the drive gear is configured to be rotatably driven in both forward and reverse directions based on the power which is transmitted from the drive motor, the displacement gear is configured by a first displacement gear which is engaged with the engaged portion when the drive gear is forwardly driven, and a second displacement gear which is engaged with the engaged portion when the drive gear is reversely driven, and the power transmission gear is engaged with the first displacement gear when the drive gear is forwardly driven. Accordingly, it is possible to improve an assembling efficiency in the entire unit along with reduction in the number of components.

According to the above described configuration, when the drive gear is forwardly driven, the first displacement gear circumferentially moves in one circumferential direction of the drive gear based on the driving force which is transmitted from the drive gear, is engaged with the engaged portion of the wiper holder, and transmits a power for wiping toward the forward direction with respect to the wiper holder.

On the other hand, when the drive gear is reversely driven, the second displacement gear circumferentially moves in the other circumferential direction of the drive gear based on the power which is transmitted from the drive gear, is engaged with the engaged portion of the wiper holder, and transmits power for wiping toward the return direction which is opposite to the forward direction with respect to the wiper holder. That is, when the drive gear is rotationally driven in both the forward and reverse directions based on the power which is transmitted from the drive motor, it is possible to wipe liquid by causing the wiper holder to perform relative movement in both directions with respect to the liquid ejecting head by transmitting the rotational driving force to the engaged portion of the wiper holder through both the displacement gears. In addition, when the first displacement gear is released from the engagement with the engaged portion of the wiper holder, the first displacement gear is engaged with the power transmission gear at the time of the forward driving of the drive gear. For this reason, it is possible to wind the wiping member when the first displacement gear is engaged with the power transmission gear, and rotates the roller after moving the wiper unit in the wiping direction.

In the wiper unit according to the aspect of the invention, the drive gear and the displacement gear are fixed when the wiper holder is moved in the wiping direction, and the power transmission gear is configured so as to move in the wiping direction integrally with the wiper holder along with the movement of the wiper holder in the wiping direction.

According to the above configuration, since the displacement gear makes relative movement in the wiping direction with respect to the power transmission gear due to a movement operation of the wiper holder to the wiping direction of liquid, whether or not the displacement gear can be engaged with the power transmission gear is varied. For this reason, it is possible to simply realize a configuration in which the wiping member is not erroneously wound around the roller when the wiper holder is moved in the wiping direction of liquid while enabling the wiping member to be wound around the roller.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, an embodiment in which an ink jet printer as a type of a liquid ejecting apparatus according to the embodiments of the invention, and a wiper unit which is provided in the printer are embodied will be described according to FIGS. 1 to 21.

Figure 1:
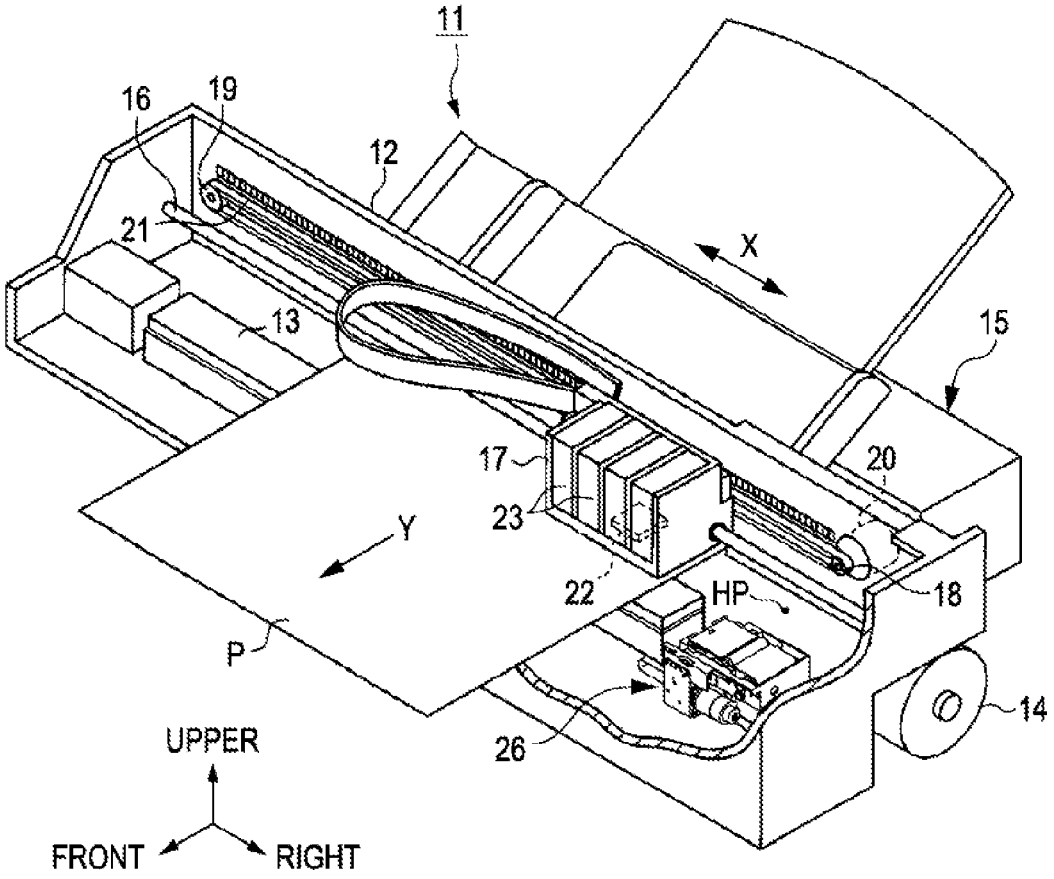
FIG. 1 is a perspective view of a printer according to embodiments of the invention.

As shown in FIG. 1, in a printer 11, a support member 13 of a substantially rectangular plate shape is provided in a state in which the longitudinal direction thereof matches the main scanning direction X (horizontal direction in FIG. 1) at the inner lower portion of a frame 12 of a substantially rectangular box shape. Recording paper P is sent onto the support member 13 from the rear side in the sub-scanning direction Y (front-back direction in FIG. 1) which is orthogonal to the main scanning direction X according to driving of a paper feed motor 14 which is provided at the rear lower portion of the frame 12. In addition, a rod-shaped guide shaft 16 which is extended in parallel to the longitudinal direction of the support member 13 is provided at the upper part of the support member 13 in the frame 12. A carriage 17 is supported in the guide shaft 16 in a state of being capable of reciprocating in the shaft axis direction thereof.

A driving pulley 18 and a driven pulley 19 are rotatably supported in each position in the inner surface of the rear wall of the frame 12 corresponding to both end portions of the guide shaft 16. The driving pulley 18 is connected with an output shaft of a carriage motor 20 as a driving source when causing the carriage 17 to reciprocate. In addition, an endless timing belt 21*a* part thereof is connected to the carriage 17 is stretched between the pair of pulleys 18 and 19. Accordingly, the carriage 17 is able to move in the main scanning direction X through the endless timing belt 21 by a driving force of the carriage motor 20 while being guided by the guide shaft 16.

A recording head 22 as a liquid ejecting head is provided on the base of the carriage 17. On the other hand, a plurality of ink cartridges 23 (four in the embodiment) which store ink (liquid) which is supplied to the recording head 22 are detachably mounted in the carriage 17. In addition, the base of the recording head 22 (surface facing support member 13) is set as the nozzle forming surface on which a plurality of nozzles (not shown) for ejecting ink droplets of each color are provided in line along the front-back direction which is orthogonal to the main scanning direction X of the carriage 17. In addition, recording onto the recording paper P is executed when ink droplets are ejected with respect to the recording paper P which is sent onto the support member 13 from the nozzles which are formed on the nozzle formation surface of the recording head 22.

In addition, as shown in FIG. 1, a head maintenance unit 26 for performing maintenance of the recording head 22 is provided at a home position HP which is provided on the right side in a recording region in the frame 12 to which the recording paper P is transmitted.

Subsequently, the head maintenance unit 26 will be described.

Figure 2:
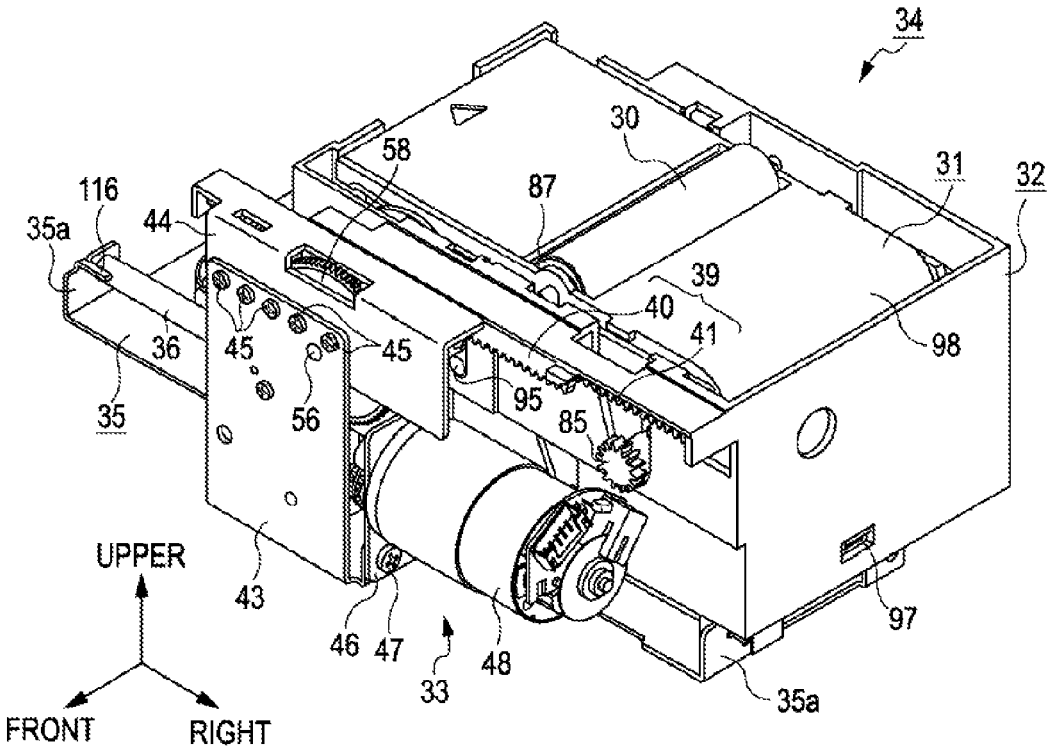
FIG. 2 is a perspective view of a wiper unit.
Figure 3:
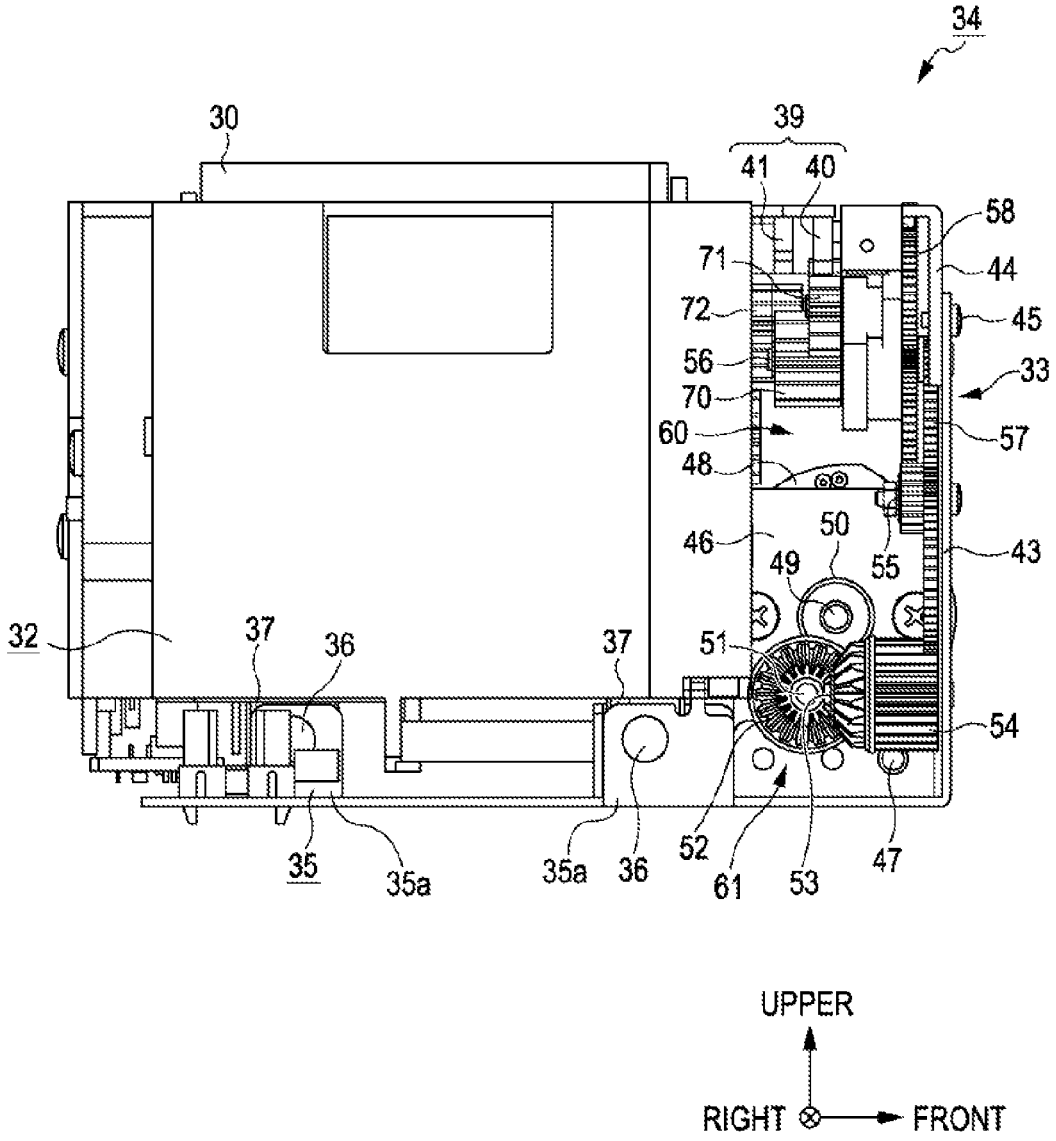
FIG. 3 is a side view of the wiper unit.

As shown in FIGS. 2 and 3, the head maintenance unit 26 includes a wiper unit 34 which is configured by a wiper cassette 31 in which a wiping member 30 which wipes ink on the nozzle formation surface of the recording head 22 is mounted, a wiper holder 32 in which the wiper cassette 31 is detachably mounted, and a driving mechanism 33 which moves the wiper holder 32 in the horizontal direction as the direction which is orthogonal to the nozzle column direction of the recording head 22. In addition, the head maintenance unit 26 includes a cap (not shown) which is provided to be in contact with the nozzle formation surface of the recording head 22 so as to surround the nozzles, in addition to the wiper unit 34, and a suction pump (not shown) which is driven in order to suck and discharge waste ink which is thickened or the like from the recording head 22 through the cap.

As shown in FIG. 2, the wiper holder 32 forms a box shape in which the wiper cassette 31 is detachably maintained in the detaching direction (vertical direction). A guide frame 35 is located at the lower part of the wiper holder 32, and is attached through a bracket (not shown) on the inner surface of the bottom wall of the frame 12 in the printer 11. Facing pieces 35*a* which form a pair at positions which are separated in the horizontal direction are formed by being bent in two portions which are separated in the front-back direction are formed in the guide frame 35, and guide shafts 36 which are extended in the horizontal direction are respectively built between each of the two facing pieces 35*a*. In addition, shaft reception units 37 (refer to FIG. 5) through which each guide shaft 36 is inserted in a sliding manner are protruded toward vertically downward on the base of the wiper holder 32. In addition, a movement of the wiper holder 32 in the horizontal direction is supported so as to be guided by the guide shaft 36 when the shaft reception unit 37 make a sliding contact with the pair of guide shafts 36 in the front and back in the shaft axis direction.

As shown in FIG. 2, a rack gear unit 39 as an engaged portion is provided at a position of the wiper holder 32 which is close to the upper part of the front wall portion of the wiper holder 32. The rack gear unit 39 is configured by a first rack gear unit 40 which is linearly extending from the left end position to a position which is close to the right of the wiper holder 32, and a second rack gear unit 41 which is linearly extending from the right end position to a position which is close to the left of the wiper holder 32. In addition, the first rack gear unit 40 is arranged at a position which is close to the front with respect to the second rack gear unit 41. That is, both the rack gear units 40 and 41 are arranged at positions which are different from each other in the front-back direction which is orthogonal to the movement direction of the wiper holder 32. In addition, both the rack gear units 40 and 41 are arranged by being deviated in the horizontal direction as the movement direction of the wiper holder 32, and are partially overlapped with each other.

In addition, as shown in FIGS. 2 and 3, a support piece 43 of which a tip end side is bent so as to form a substantial L shape toward the upper side is extended from the guide frame 35 at the substantial center portion of the guide frame 35 in the front end portion in the horizontal direction. In addition, a support frame 44 of which the upper end is bent so as to form a substantial L shape toward the rear part as the inner part of the wiper holder 32 is fixed by a locking screw 45 to the upper end of the support piece 43. In addition, an attachment frame 46 is fixed to the right end portion of the base portion which is extended in the horizontal direction in the support piece 43 using the locking screw 47, and a driving motor 48 as a driving source of the driving mechanism 33 is supported through the attachment frame 46.

As shown in FIG. 3, an output gear 50 is provided in an output shaft 49 of the driving motor 48 so as to be integrally rotated with the output shaft 49. In addition, a bevel gear 52 which is pivotally supported by a shaft 51 is engaged with the output gear 50 from below. In addition, a bevel gear 54 which is pivotally supported by a shaft 53 is engaged with the bevel gear 52 which is located at the rear side thereof, from the front side. In addition, the bevel gear 54 is engaged with a driven gear 58 which is pivotally supported by a shaft 56 through a driven gear 57 which is pivotally supported by the shaft 55 so as to transmit power. In addition, a planetary gear mechanism 60 is provided at the shaft 56. In addition, according to the embodiment, a power transmission mechanism 61 which transmits power which is output from the driving motor 48 to the planetary gear mechanism 60 is configured by the shafts 51, 53, 55, and 56, the bevel gears 52 and 54, and the driven gears 57 and 58.

Figure 4:
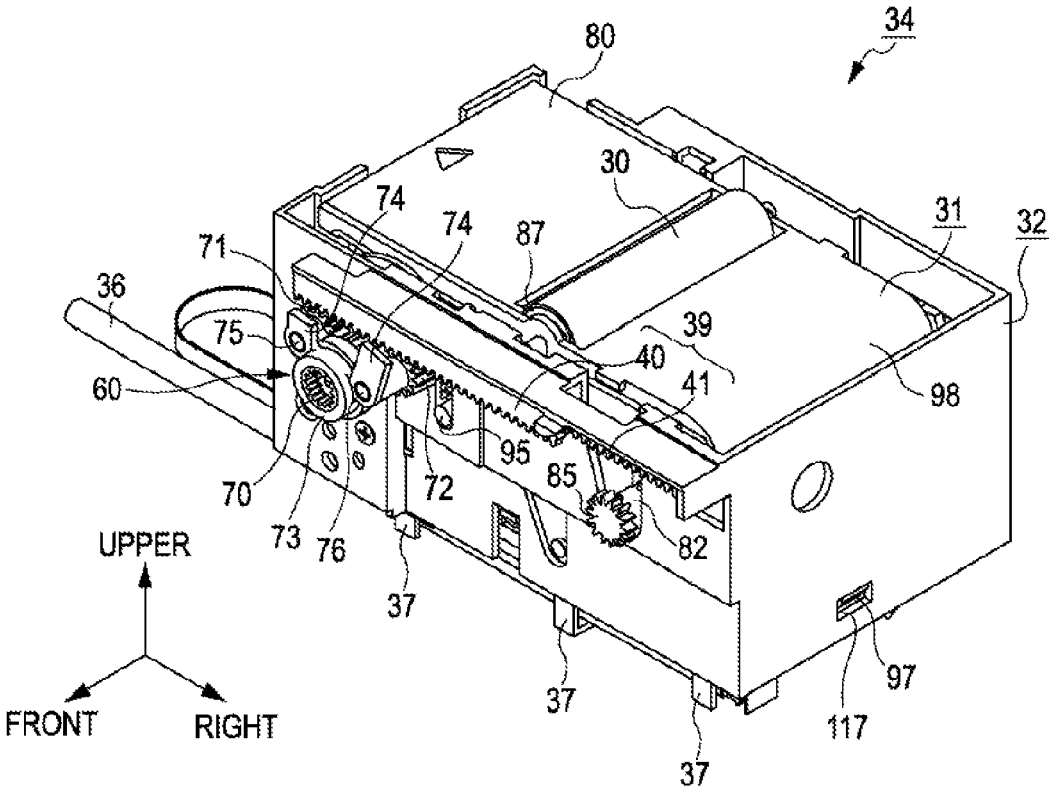
FIG. 4 is a perspective view of the wiper unit in which a part of a configuration is omitted.
Figure 5:
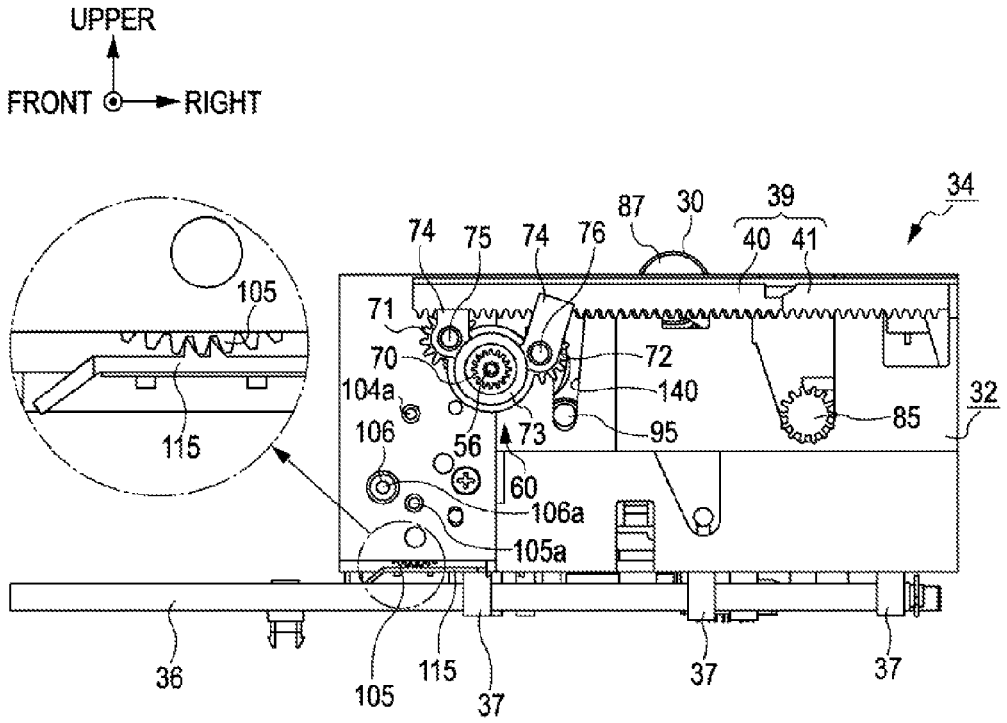
FIG. 5 is a front view of the wiper unit which is illustrated in FIG. 4.

In FIGS. 4 and 5, the wiper unit 34 in which the driving motor 48, a power transmission mechanism 61, a support frame 44, and the guide frame 35 are omitted is illustrated. In addition, as shown in FIGS. 4 and 5, the planetary gear mechanism 60 includes a sun gear 70, a plurality of (two in the embodiment) planetary gears 71 and 72 as displacement gears which revolve around the sun gear 70, and a base member 73 which swings while rotatably supporting the planetary gears 71 and 72.

The base member 73 is rotatably supported by the shaft 56 in which a pair of arm portions 74 is protruded so as to be branched from a base end portion, and forms a substantially V shape when seen from the side, and the base end portion is set as a rotating shaft of the sun gear 70. In addition, the planetary gears 71 and 72 are rotatably supported by the pair of arm portions 74 which are formed in the base member 73, through the shafts 75 and 76 to which the planetary gears 71 and 72 correspond, respectively.

In addition, these planetary gears 71 and 72 are arranged at positions which are different from each other in the shaft axis direction of the shaft 56. Specifically, the planetary gear 71 on one side (left side in FIGS. 4 and 5) in these planetary gears 71 and 72 is arranged at the same position as the first rack gear unit 40 in the shaft axis direction of the shaft 56, and the planetary gear 72 on the other side (right side in FIGS. 4 and 5) is arranged at the same position as the second rack gear unit 41 in the shaft axis direction of the shaft 56. In addition, as shown in FIGS. 4 and 5, when the first rack gear unit 40 is located at the vertically upper part of the sun gear 70, the first rack gear unit 40 is located on a movement pathway of the planetary gear 71 which revolves around the sun gear 70. On the other hand, when the wiper holder 32 moves to the left along the guide shaft 36 from a state shown in FIGS. 4 and 5, and the second rack gear unit 41 is located at the vertically upper part of the sun gear 70, the second rack gear unit 41 is located on a movement pathway of the planetary gear 72 which revolves around the sun gear 70.

In addition, when the power which is output from the driving motor 48 is transmitted to the sun gear 70 of the planetary gears mechanism 60 through the power transmission mechanism 61, each of the planetary gears 71 and 72 of the planetary gear mechanism 60 revolves around the sun gear 70 according to a driving force which is transmitted from the sun gear 70. As a result, each of the planetary gears 71 and 72 is engaged with the rack gear units 40 and 41 to which the planetary gears correspond, respectively, so as to be able to transmit power. In this case, the power which is output from the driving motor 48 is transmitted as power which moves the wiper holder 32 in the horizontal direction as the shaft axis direction of the guide shaft 36. In this point, according to the embodiment, the driving mechanism 33 which moves the wiper holder 32 in the horizontal direction which is orthogonal to the nozzle column direction of the recording head 22 is configured by the driving motor 48, the power transmission mechanism 61, and the planetary gear mechanism 60.

Figure 6A:
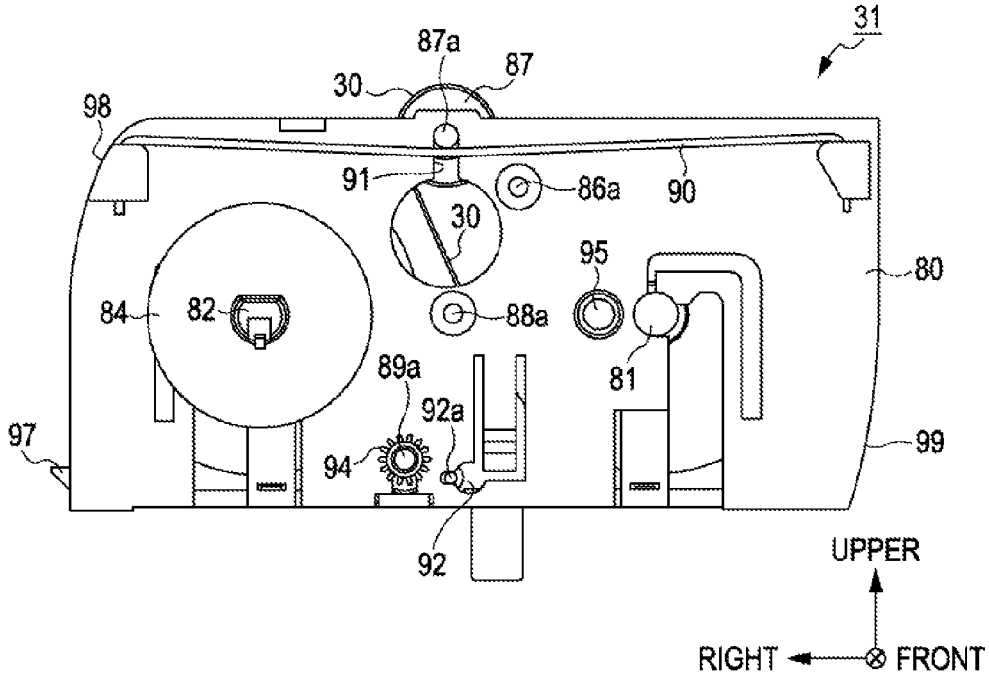
FIG. 6A is a front view of a wiper cassette.
Figure 6B:
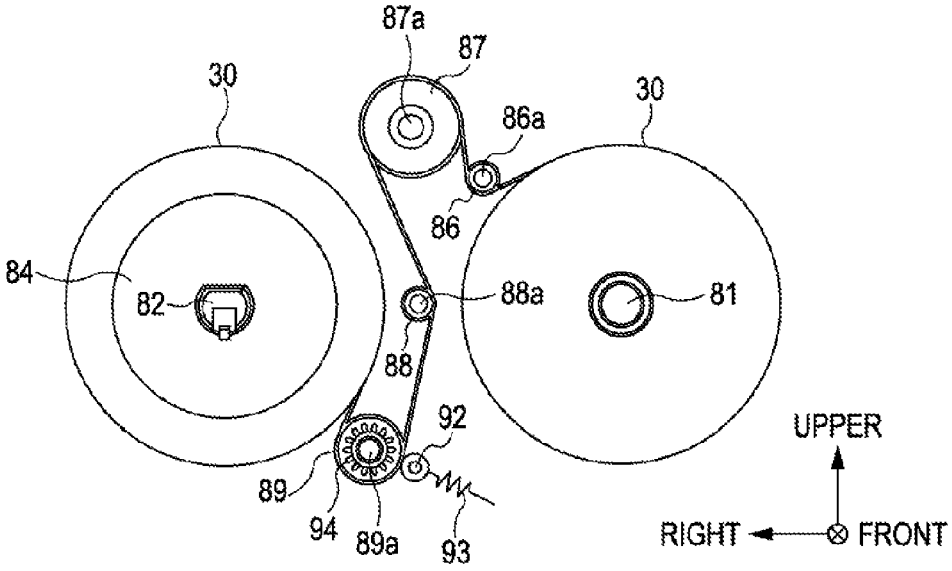
FIG. 6B is a front view of the wiper cassette in which a housing is omitted.

As shown in FIGS. 6A and 6B, a pair of rollers 81 and 82 which has a shaft axis which is horizontally extended in the front-back direction as the lateral direction of a housing 80 are accommodated inside the housing 80 which forms a substantial rectangle box shape which configures the exterior of the wiper cassette 31 at a distance in the horizontal direction as the longitudinal direction of the housing 80. The long wiping member 30 for wiping ink on the nozzle formation surface of the recording head 22 is stretched between the pair of rollers 81 and 82. In addition, in the pair of rollers 81 and 82, the reeling-out roller 81 as the first roller provided on the left side which is close to a recording region in which the recording head 22 executes recording with respect to the recording paper P reels out the wound wiping member 30 which is unused. On the other hand, in the pair of rollers 81 and 82, the winding-up roller 82 as the second roller on the right side which is close to the side which is opposite to the recording region in which the recording head 22 executes recording with respect to the recording paper P winds up the used wiping member 30 which is reeled out from reeling-out roller 81, and is used for wiping. In addition, the reeling-out roller 81 and the winding-up roller 82 are located at substantially the same height as each other. In addition, a reeling-out gear 83 (refer to FIG. 8) is provided so as to be integrally rotatable with the reeling-out roller 81. In addition, at both ends of the winding-up roller 82 in the shaft axis direction which is exposed to the outside of the housing 80, a winding-up gears 84 and 85 (refer to FIGS. 7 and 8) are provided at both end portions of the winding-up roller 82 which is exposed to the outside of the housing 80 so as to be integrally rotatable with the winding-up roller 82.

In addition, a plurality of rollers (four in the embodiment) 86, 87, 88, and 89 are provided on the reeling-out path of the wiping member 30 from the reeling-out roller 81 to the winding-up roller 82 inside the housing 80. These rollers 86, 87, 88, and 89 are extended in parallel to the reeling-out roller 81 and the winding-up roller 82 front and rear, and both ends thereof in the front-back direction are rotatably supported by the shaft reception unit or the like which is provided on the side wall portion of the housing 80.

Specifically, a portion of the wiping member 30 which is reeled out from the reeling-out roller 81 is wound around a press roller 87 which is provided at the obliquely right upper part of the reeling-out roller 81. A shaft unit 87*a* on both ends of the press roller 87 in the shaft axis direction is supported from below by a torsion bar 90 which is fixed to the outer surface of the housing 80 in both the front and back. The torsion bar 90 supports a shaft unit 87*a* of the press roller 87 in the middle position thereof in the longitudinal direction. In a the shaft unit 87*a* of the press roller 87 passes through a shaft reception hole 91 which is provided in the housing 80 in a sliding manner back and forth, and is in close contact with an upper hole edge of the shaft reception hole 91 by an urging force to the upper part from the torsion bar 90. In addition, the shaft unit 87*a* of the press roller 87 is rotatably supported from above and below between the torsion bar 90 and the hole edge of the shaft reception hole 91. In addition, the top portion of the press roller 87 on the circumferential surface is located at the upper part of the housing 80, and the portion of the wiping member 30 which is wound around the press roller 87 protrudes upward from the top face of the housing 80. In addition, the top portion of the press roller 87 on the circumferential surface is located at the upper part of the nozzle formation surface of the recording head 22.

In addition, a relay roller 89 which winds up a portion of the wiping member 30 which is reeled out from the press roller 87 is provided at the vertically lower part of the press roller 87. In addition, a pinch roller 92 which interposes the wiping member 30 between the relay roller 89 and the pinch roller 92 is provided at a position which is opposite to the relay roller 89 by interposing the wiping member 30. In addition, a spring member 93 as an urging member is provided between the inner surface of the bottom wall of the housing 80 and the pinch roller 92. In addition, the pinch roller 92 is urged in the direction approaching the relay roller 89 by the spring member 93.

In addition, in the relay roller 89, a relay gear 94 is provided so as to integrally rotate with the relay roller 89 at an end portion of the shaft portion 89*a* on one side (rear side in FIGS. 6A and 6B) in the shaft axis direction which is exposed to the outside from the side wall portion of the housing 80. In addition, end portions of the shaft portions 92*a* at both ends of the pinch roller 92 in the shaft axis direction are exposed to the outside from a shaft reception unit of a cut-out groove shape which is formed when forming a cut-out elastic piece on the side wall portion of the housing 80.

In addition, on the reeling-out path of the wiping member 30 from the reeling-out roller 81 to the winding-up roller 82, tension rollers 86 and 88 which apply tension to the wiping member 30 are provided between the reeling-out roller 81 and the press roller 87, and between the press roller 87 and the relay roller 89. In addition, end portion of the shaft portions 86*a* and 88*a* on both ends of the tension rollers 86 and 88 in the shaft axis direction are exposed to outside from a circular concave-shaped shaft reception unit which is provided on the side wall portion of the housing 80.

In addition, on both the front and rear side surfaces of the housing 80, an engaging protrusion 95 as an engaging convection portion of a substantial cylindrical shape is horizontally provided toward the front-back direction in a protruding manner. The engaging protrusion 95 is formed at a position which is close to the left part as the recording region side of the recording head 22 of the center position of the housing 80 in the horizontal direction, and the substantially center position of the housing 80 in the vertical direction.

In addition, an elastic piece 96 (refer to FIG. 7) of which the upper end side is a fixed end with respect to the housing 80, and the lower end side is a free end is formed at a position which is close to the base of the housing 80 on the right side surface. The elastic piece 96 can be elastically deformed in the horizontal direction using the fixed end on the upper end side as a fulcrum. In addition, a locking claw 97 as a locking unit of a substantially triangular shape when seen on the side is formed on the lower end side as the free end of the elastic piece 96.

In addition, curved surfaces 98 and 99 which are curved in substantial arc shapes, and are convexes toward the outside of the housing 80 are formed at the right upper corner and the left lower corner as portions which are connected to an end portion of the wiper cassette 31 in the detaching direction (horizontal direction) in the housing 80. These curved surfaces 98 and 99 have shapes which are evacuated to the inside of other portions on the outer surface of the housing 80. Further, a hooking unit 100 as a power point action unit in which a user applies an external force in the detaching direction by hooking fingertips is recessively provided (refer to FIG. 8) at a position which is close to the above on the left side surface of the housing 80 when detaching the wiper cassette 31 from the wiper holder 32.

Figure 7:
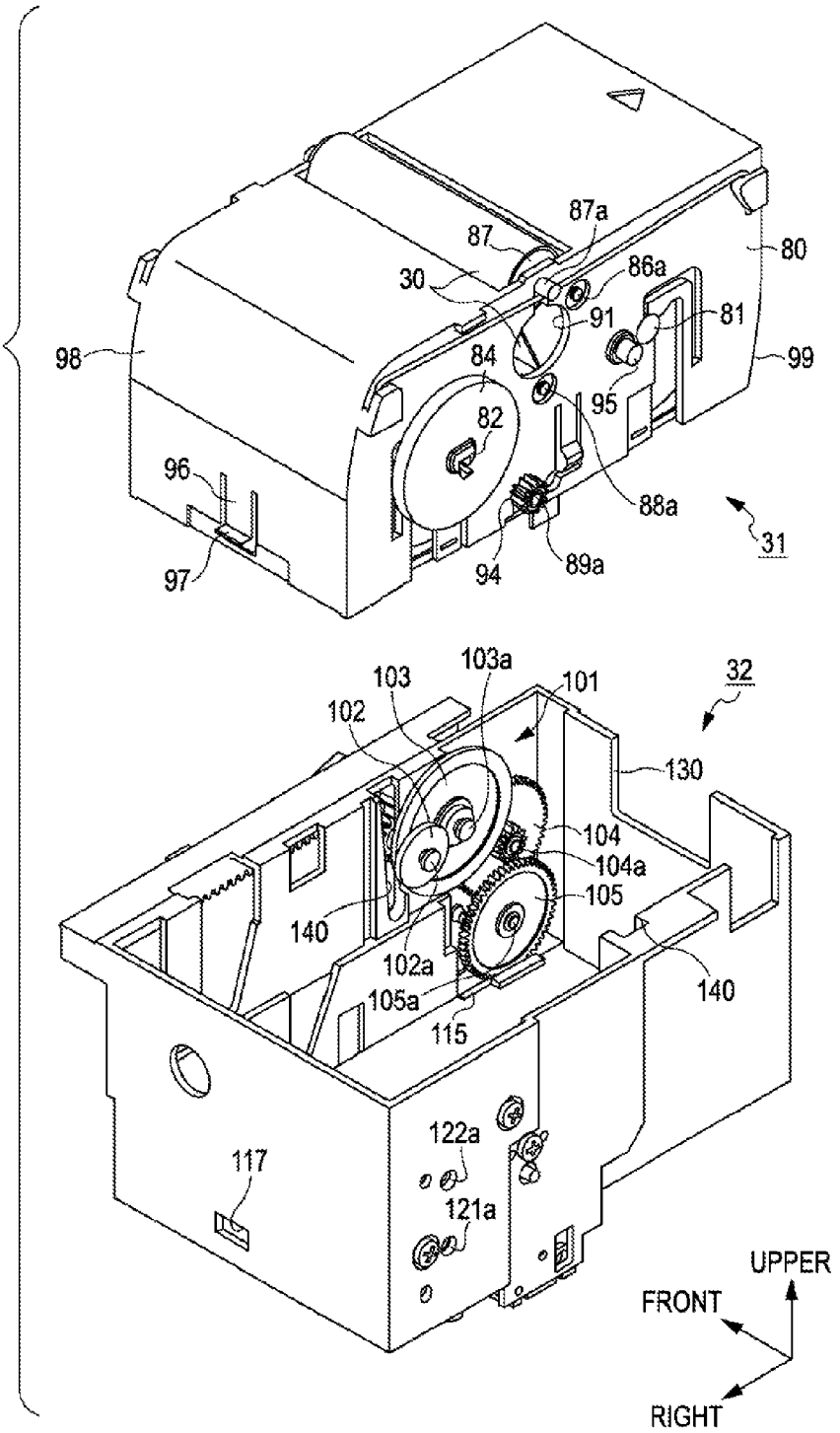
FIG. 7 is a perspective view of a state in which the wiper cassette is taken out upward from a wiper holder is seen from obliquely above on the right rear.

As shown in FIG. 7, a gear group 101 which is connected to a reeling-out gear 83 to be able to transmit power at a position which is close to the left end corresponding to the reeling-out roller 81 of the wiper cassette 31 to be mounted is provided on the inner surface of the front wall portion of the wiper holder 32. The gear group 101 is configured by a plurality of (five in the embodiment) driven gears 102, 103, 104, 105, and 106 (refer to FIG. 5). In addition, in FIG. 7, the four driven gears 102, 103, 104, and 105 which configure the gear group 101 are illustrated, however, the driven gear 106 which is engaged with the driven gears 104 and 105 is not shown since it is hidden behind (front side) the driven gear 105. The driven gears 104, 105, and 106 among the gear group 101 are rotatably supported by shafts 104*a*, 105*a*, and 106*a* (refer to FIG. 5) to which the driven gears correspond respectively, and which are supported by being passed through the front wall portion of the wiper holder 32 in a sliding manner, and the driven gears 102 and 103 are supported by shafts 102*a* and 103*a* which are provided in the wiper cassette. In addition, gears which are close to each other are engaged with each other so as to transmit power. In addition, the reeling-out gear 83 and the driven gear 102 are engaged with each other, and a driving force is transmitted to the driven gear 105. A ratchet 115 (refer to FIG. 5) of which the base end side is supported on one side by the bottom wall portion of the wiper holder 32 is engaged with the driven gear 105.

As shown in FIG. 5, an engaging portion of the ratchet 115 which is formed at the tip end side is engaged with the driven gear 105 from below. In addition, when the driven gear 105 is rotated in one rotation direction (clockwise direction when seen from the front in the embodiment) around the shaft 105*a*, the ratchet 115 is released from an engaged state with respect to the driven gear 105, when being elastically deformed in the direction which is away from the driven gear 105 having the base end side which is supported on one side as the fixed end, according to power which is acted from the driven gear 105, thereby allowing rotating of the driven gear 105. On the other hand, when the driven gear 105 is rotated in the other rotation direction (counterclockwise direction when seen from the front in the embodiment) around the shaft 105*a*, the ratchet 115 regulates the rotation of the driven gear 105 by maintaining the engaged state with respect to the driven gear 105, even when the power is acted from the driven gear 105. In addition, the rotation of the reeling-out roller 81 which is connected to the driven gear 105 to be able to transmit the power to the driven gear 105 is also regulated along with the regulation of rotation of the driven gear 105 by the ratchet 115. Specifically, the rotation of the reeling-out roller 81 in the clockwise direction when seen from the front as the direction in which the wound wiping member 30 is reeled out is regulated. That is, the ratchet 115 configures a regulation unit which regulates the rotation of the reeling-out roller 81 in the direction in which the wiping member 30 is reeled out. In addition, as shown in FIG. 2, on the left end portion of the guide frame 35, a protruding piece 116 which is protruding to the ratchet 115 side is formed at a position facing the ratchet 115 in the horizontal direction as the movement direction of the wiper holder 32.

In addition, as shown in FIG. 7, a hooking hole 117 is formed at a position corresponding to the locking claw 97 of the wiper cassette 31 in a penetrating manner on the right wall portion of the wiper holder 32. In addition, when the wiper cassette 31 is mounted with respect to the wiper holder 32, the wiper cassette 31 is stably mounted with respect to the wiper holder 32 when the locking claw 97 of the wiper cassette 31 is locked with respect to the hooking hole 117 of the wiper holder 32.

Figure 8:
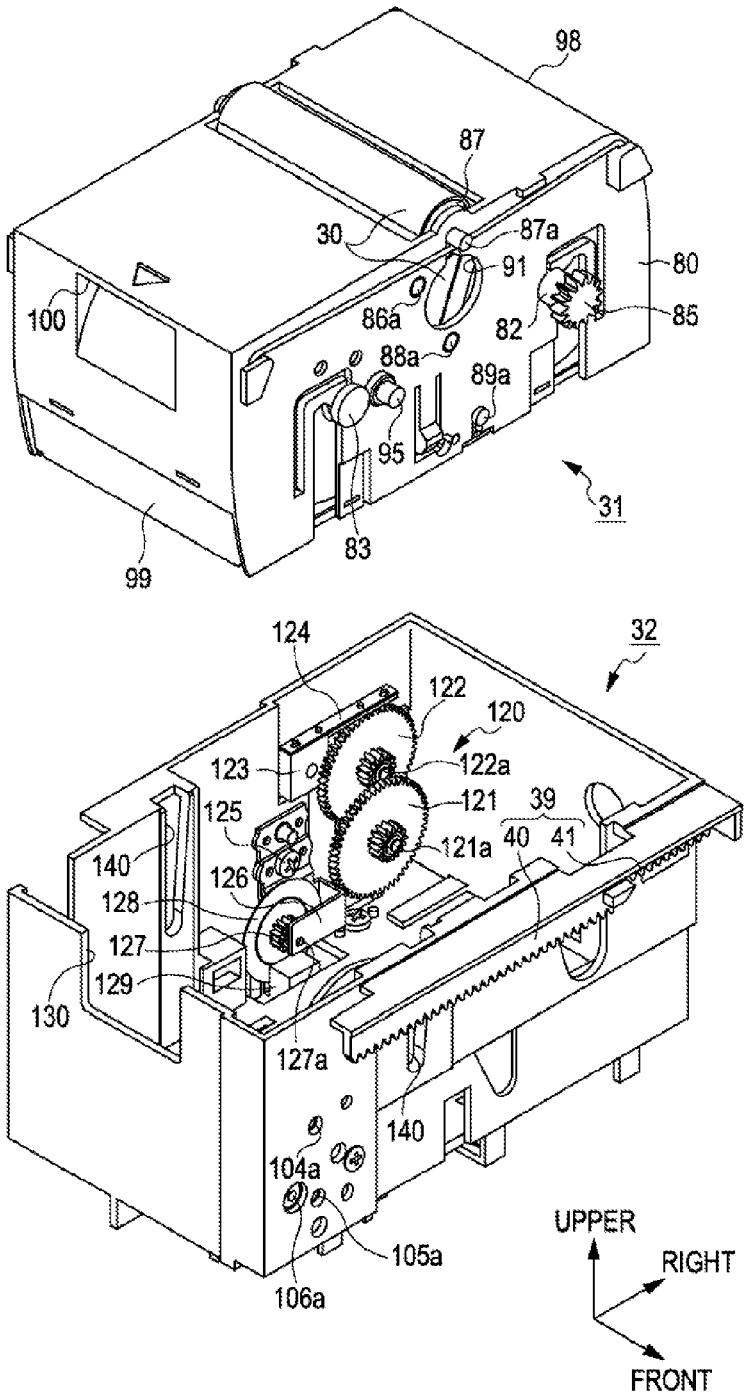
FIG. 8 is a perspective view of a state in which the wiper cassette is taken out upward from the wiper holder is seen from obliquely above on the left front.
Figure 9:
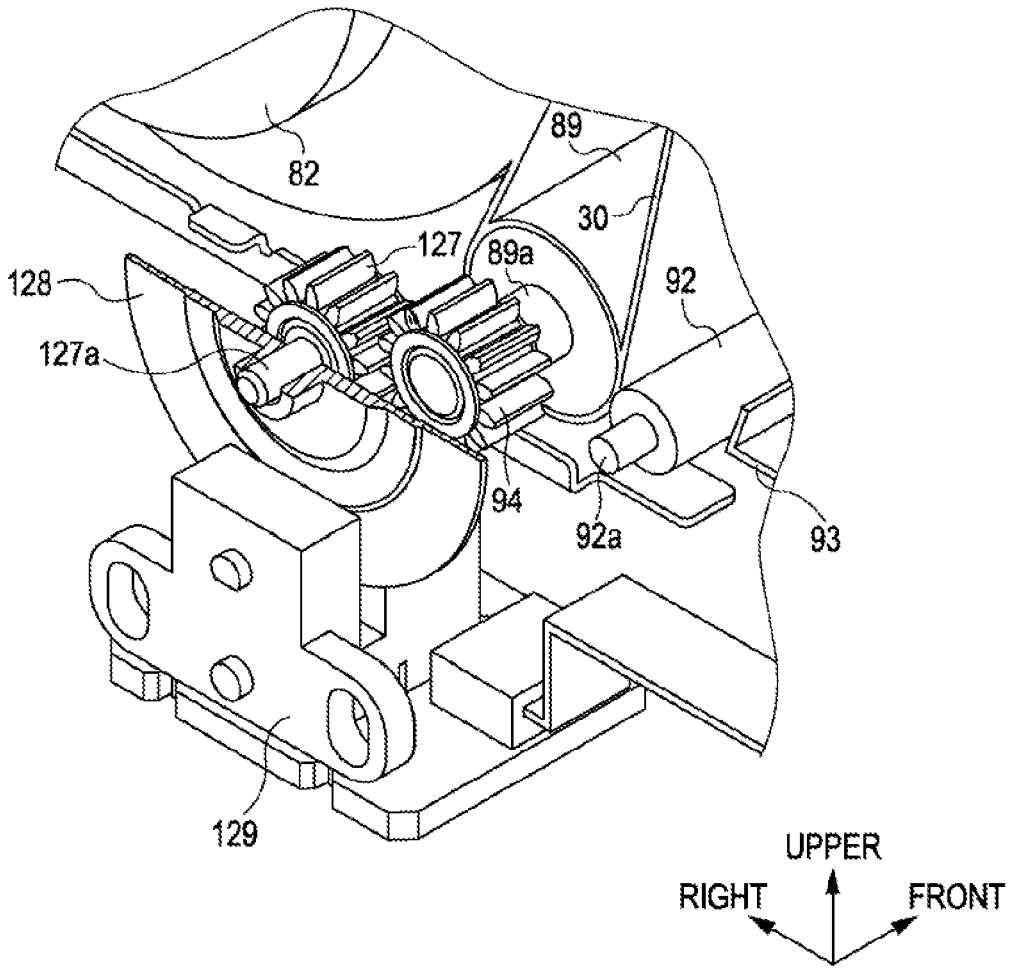
FIG. 9 is a perspective view in which a part illustrating a mechanism for detecting a rotation amount of the relay roller is cut.

As shown in FIG. 8, a gear group 120 which is connected to the winding-up gear 84 to be able to transmit power is provided at a position which is close to the right end corresponding to the winding-up roller 82 of the wiper cassette 31 which is mounted is provided on the inner surface of the rear wall portion of the wiper holder 32. The gear group 120 is configured by a plurality of (two in the embodiment) driven gears 121 and 122. These driven gears 121 and 122 are rotatably supported by shafts 121*a* and 122*a* which are supported by the rear wall portion of the wiper holder 32 by being inserted thereto, and to which the driven gears correspond, respectively, and are engaged with each other so as to be able to transmit power. In addition, in these driven gears 121 and 122, a ratchet 124 which is supported on one side by a support member 123 of which the base end portion is fixed to the inner surface side of the rear wall portion of the wiper holder 32 is engaged with the driven gear 122 (upper driven gear in FIG. 8) which is located by being separated from the winding-up gear 84 on the power transmission path from the winding-up gear 84.

An engaging portion of the ratchet 124 which is formed on the tip end side is engaged with the driven gear 122 from above. In addition, when the driven gear 122 is rotated in one rotation direction around the shaft 122*a* (clockwise direction when seen from the front in the embodiment), the ratchet 124 is released from an engaged state with respect to the driven gear 122, when being elastically deformed in the direction which is away from the driven gear 122 having the base end side which is supported on one side as the fixed end, according to power which is acted from the driven gear 122, thereby allowing rotating of the driven gear 122. On the other hand, when the driven gear 122 is rotated in the other rotation direction (counterclockwise direction when seen from the front in the embodiment) around the shaft 122*a*, the ratchet 124 regulates the rotation of the driven gear 122 by maintaining the engaged state with respect to the driven gear 122, even when the power is acted from the driven gear 122. In addition, the rotation of the reeling-out roller 82 which is connected to the driven gear 122 to be able to transmit the power is also regulated along with the regulation of rotation of the driven gear 122 by the ratchet 124. Specifically, the rotation of the winding-up roller 82 in the counterclockwise direction when seen from the front as the direction in which the wound wiping member 30 is reeled out is regulated. That is, the ratchet 124 configures a regulation unit which prevents the wiping member 30 from being reeled out, and sagged, when the winding-up roller 82 is rotated in the direction opposite to the winding-up direction.

In addition, on the inner surface side of the rear wall portion of the wiper holder 32, a support frame 126 is fixed to substantially the center position in the horizontal direction of the mounted wiper cassette 31 corresponding to the relay roller 89 by a locking screw 125. A shaft 127*a* which is inserted to the support frame 126 is provided with a driven gear 127 so as to be integrally rotated. In addition, as sown in FIG. 9, when the wiper cassette 31 is mounted with respect to the wiper holder 32, a relay gear 94 which is provided at the wiper cassette 31 side is engaged with the driven gear 127 provided on the wiper holder 32 side to be able to transmit power. In addition, a slit plate 128 is provided at the shaft 127*a* so as to be integrally rotated. In addition, a rotation amount of the shaft 127*a* is detected by a rotary encoder 129 as the rotation amount detection unit which is fixed to the wiper holder 32.

In addition, as shown in FIGS. 7 and 8, a concave portion 130 as a cut-out portion is formed at a portion corresponding to the hooking unit 100 of the wiper cassette 31 on the left wall portion of the wiper holder 32. The concave portion 130 is provided in a protruding manner from the upper end surface to the lower part of the left wall portion of the wiper holder 32. In addition, the hooking unit 100 of the wiper cassette 31 which is mounted in the wiper holder 32 is exposed to the outside of the wiper holder 32 through the concave portion 130.

In addition, on both the front and rear side wall portions of the wiper holder 32, an engaging concave portion 140 is provided at a position corresponding to the engaging protrusion 95 of the wiper cassette 31 in the horizontal direction. The engaging concave portion 140 is extended in the vertical direction as the detaching direction of the wiper cassette 31 from both the front and rear side wall portions of the wiper holder 32 to the substantially center position of both the front and rear side wall portions of the wiper holder 32 in the vertical direction. A horizontal size of an upper opening in the engaging concave portion 140 is set to be slightly larger than a diameter of the engaging protrusion 95, and the horizontal size is configured so as to be gradually narrowed toward the bottom.

Figure 10:
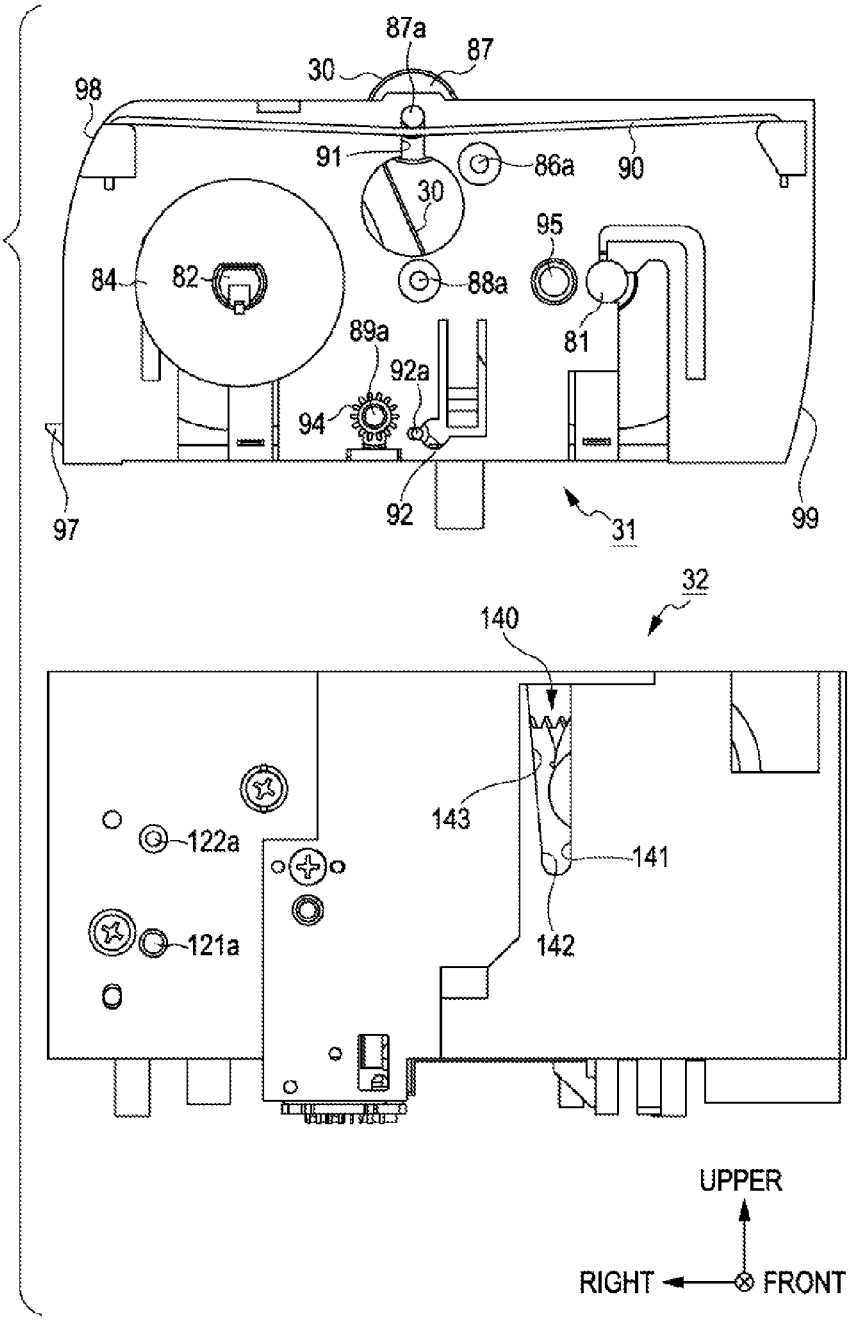
FIG. 10 is a front view which illustrates a state in which the wiper cassette is taken out upward from the wiper holder.

Specifically, as shown in FIG. 10, the inner surface on the right in the engaging concave portion 140 which is close to the concave portion 130 is configured by a vertical plane 141 which is linearly extending in the vertical direction. On the other hand, in the engaging concave portion 140, the inner surface on the right which is located to be close to the opposite side to the concave portion 130 is configured by a vertical plane 142 of which the lower end is linearly extended in the vertical direction, and the upper part thereof is configured by a slope 143 which is tilted in the vertical direction so that the upper part thereof becomes a rising gradient toward the right part which is away from the concave portion 130. In addition, a distance between the vertical planes 141 and 142 on both sides which are located at the lower end of the engaging concave portion 140 is approximately the same as a diameter of the engaging protrusion 95.

Subsequently, operations of the printer 11 which is configured as above will be described in below with reference to FIGS. 11 to 18, in particular, by focusing on operations of the wiper unit 34 when wiping ink from the nozzle formation surface of the recording head 22. In addition, in FIGS. 11 to 18, the tension rollers 86 and 88, and the relay roller 89 will be omitted.

Figure 11A:
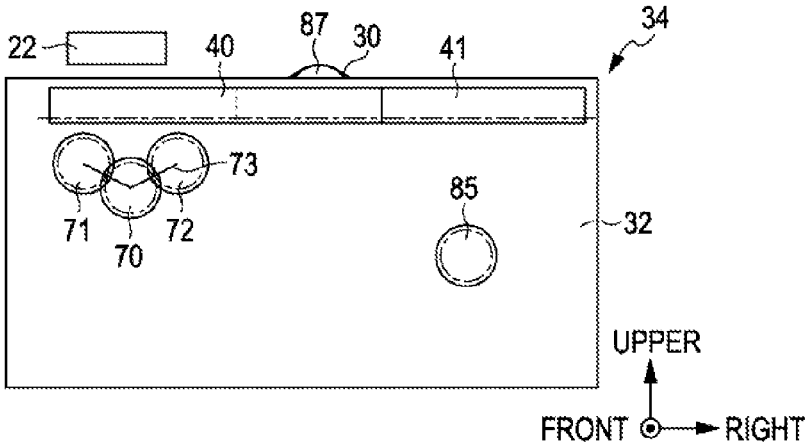
FIG. 11A is a front view which schematically illustrates the wiper unit before starting a wiping operation.
Figure 11B:
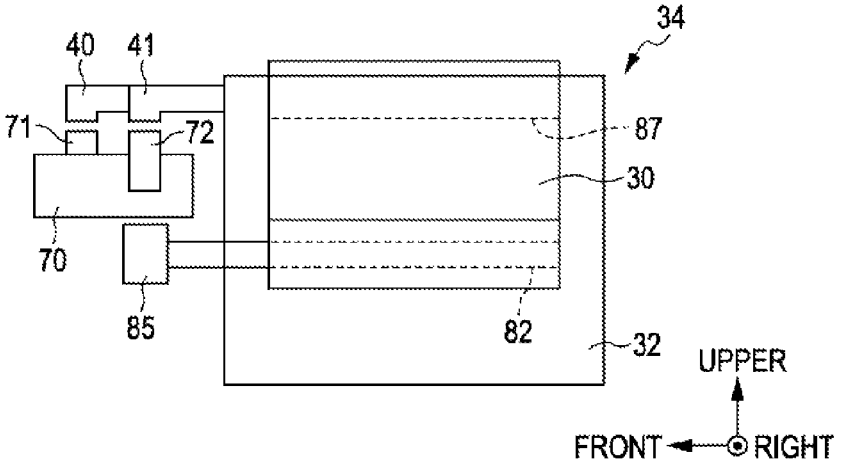
FIG. 11B is a side view which schematically illustrates the wiper unit in FIG. 11A.
Figure 11C:
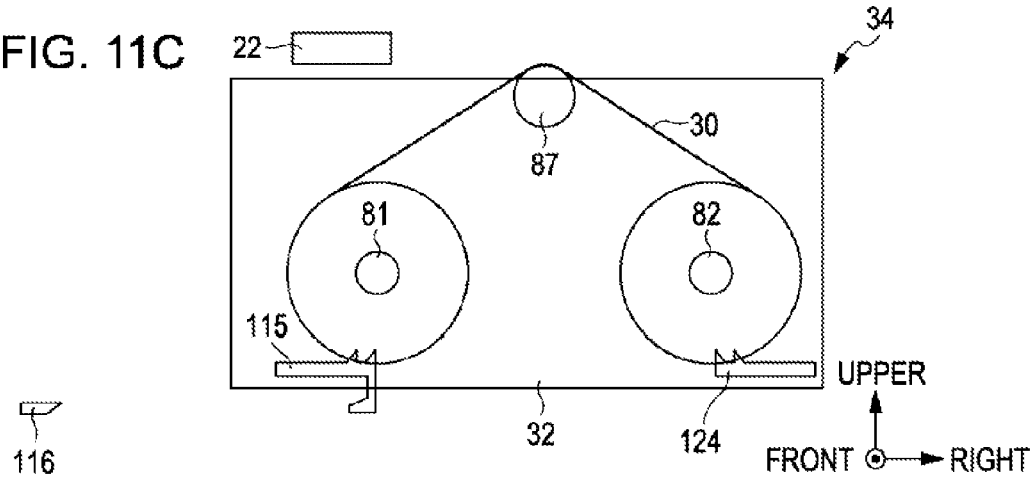
FIG. 11*c* is a front view which schematically illustrates an internal configuration of the wiper unit in FIG. 11C.

First, when the wiper unit 34 wipes ink from the nozzle formation surface of the recording head 22, the carriage 17 moves to the home position HP. In this case, as shown in FIGS. 11A to 11C, in a state in which the wiper holder 32 is arranged at the initial position, the recording head 22 is located on the left of the press roller 87. In addition, at the vertical upper part of the sun gear 70, the first rack gear unit 40 is located on the circumferential path of the planetary gear 71. However, the planetary gear 71 is not engaged with the first rack gear unit 40. In addition, the second rack gear unit 41 and the winding-up gear 85 is located at a position which is away from the circumferential path of the planetary gear 72.

Figure 12A:
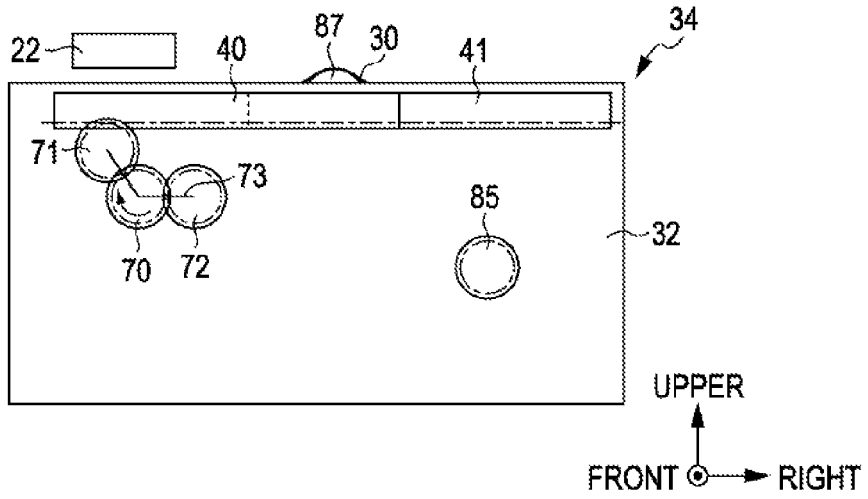
FIG. 12A is a front view which schematically illustrates the wiper unit in a state in which a planetary gear is engaged with a first rack gear unit.
Figure 12B:
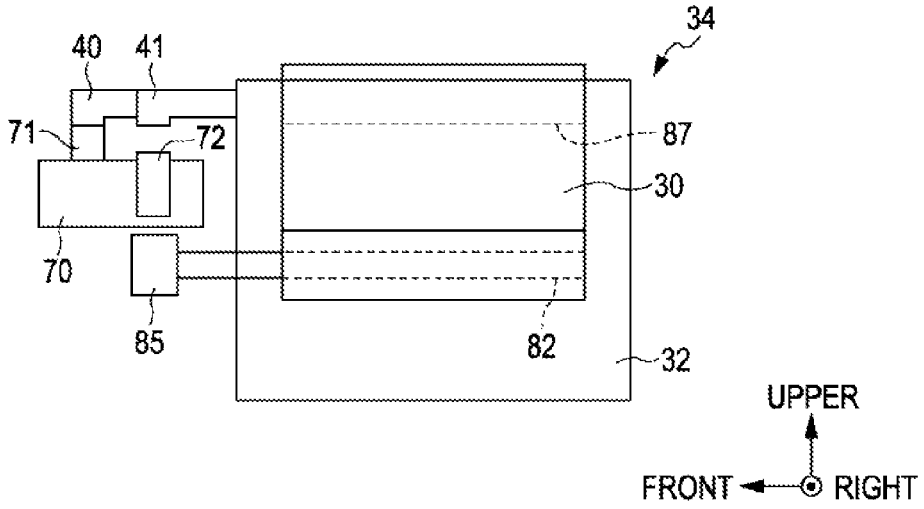
FIG. 12B is a side view which schematically illustrates the wiper unit in FIG. 12A.
Figure 13A:
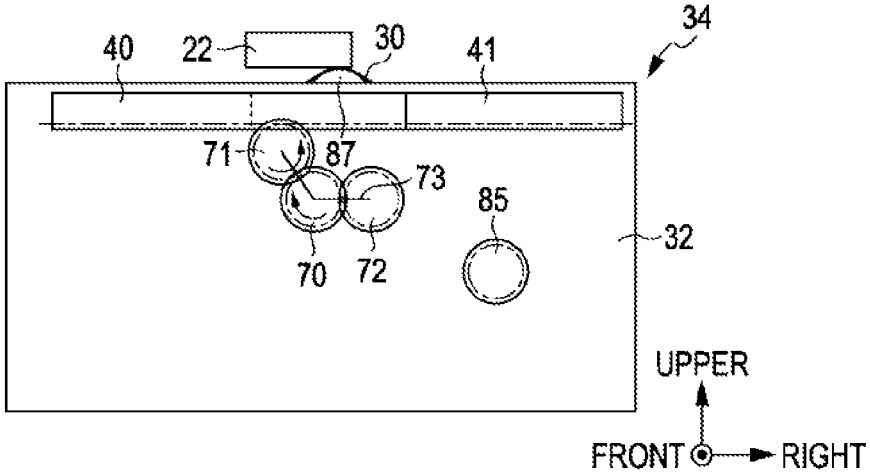
FIG. 13A is a front view which schematically illustrates the wiper unit in a state of wiping the recording head in the forward direction.
Figure 13B:
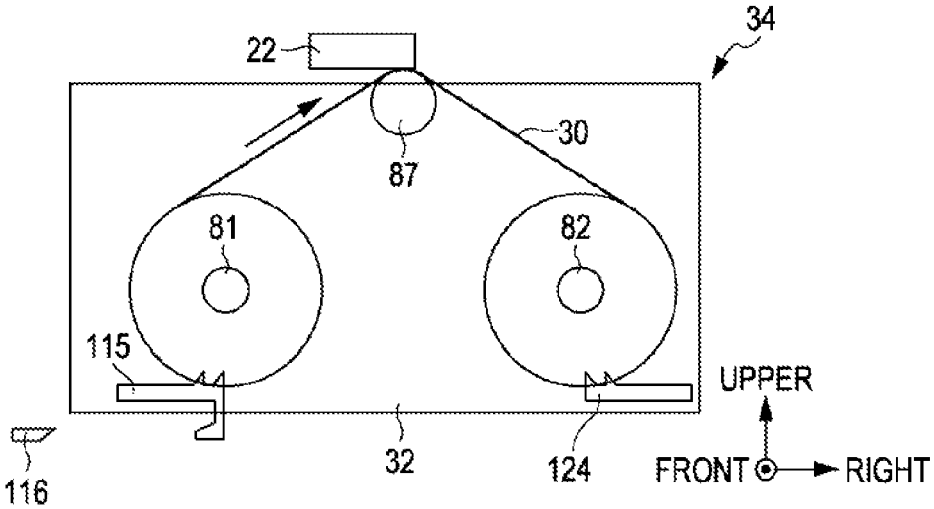
FIG. 13B is a front view which schematically illustrates an internal configuration of the wiper unit in FIG. 13A.

Subsequently, the sun gear 70 rotates in the clockwise direction in FIG. 11A along with a forward driving of the driving motor 48. Then, the planetary gears 71 and 72 revolve around the sun gear 70 in the clockwise direction. In addition, as shown in FIGS. 12A and 12B, the planetary gear 71 is displaced to an engaging position with respect to the first rack gear unit 40. That is, at the time of forward driving of the drive motor 48, the planetary gear 71 functions as a first displacement gear which is engaged with the first rack gear unit 40.

Then, the planetary gear 71 is rotated in a state of being engaged with the first rack gear unit 40, the wiper holder 32 moves to the right toward the recording head 22 according to the driving force which is transmitted from the planetary gear 71 along with the movement of the first rack gear unit 40.

In addition, as shown in FIGS. 13A and 13B, and FIGS. 14A and 14B, a portion of the wiping member 30 which is wound around the press roller 87 wipes ink from the nozzle formation surface by being in sliding contact with the recording head 22 along with a movement in the left direction as the forward direction with respect to the nozzle formation surface of the recording head 22 along with a movement of the wiper holder 32. The wiped ink is absorbed by the wiping member 30. In this case, since the press roller 87 is urged to the vertically upward as the direction which is closed to the recording head 22 by the torsion bar 90, the wiping member 30 is pressed to the nozzle formation surface of the recording head 22 according to an applied force from the torsion bar 90.

Accordingly, due to a friction force which is generated when the wiping member 30 makes a sliding contact with the nozzle formation surface of the recording head 22, tension acts on the wiping member 30 in the direction in which the wiping member 30 is reeled out from the reeling-out roller 81. Regarding this, according to the embodiment, the rotation of the reeling-out roller 81 in the direction in which the wiping member 30 is reeled out is regulated by the ratchet 115. For this reason, when wiping ink from the nozzle formation surface of the recording head 22, the wiping member 30 is rarely sagged when being reeled out from the reeling-out roller 81.

Figure 14A:
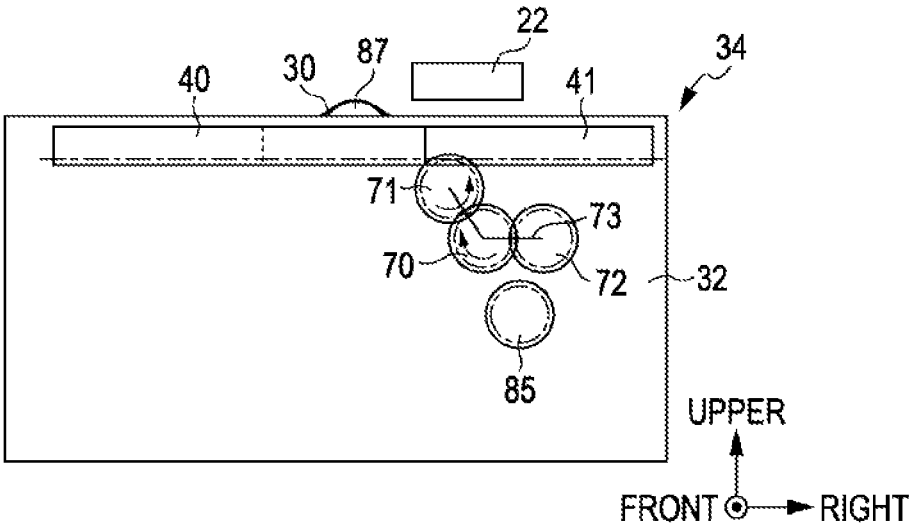
FIG. 14A is a front view which schematically illustrates the wiper unit which is located at a winding-up position of the wiping member.
Figure 14B:
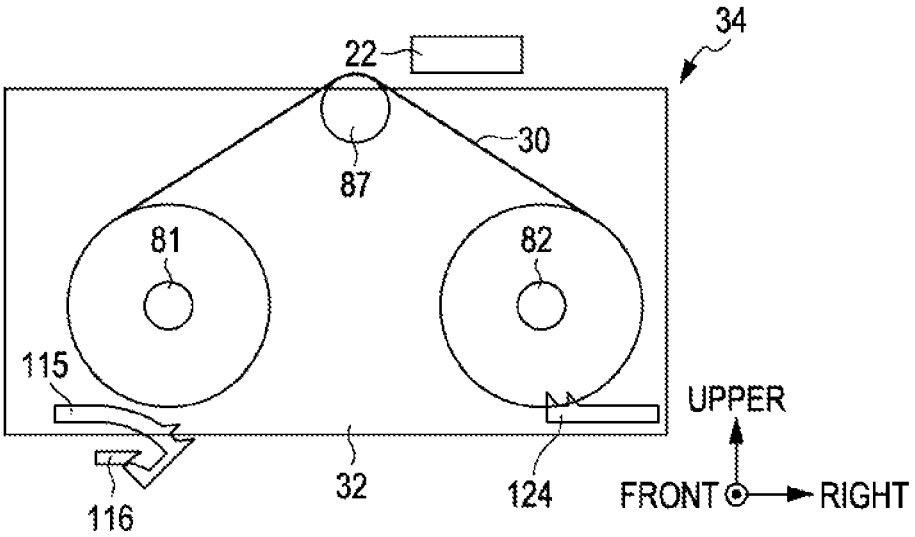
FIG. 14B is a front view which schematically illustrates an internal configuration of the wiper unit in FIG. 14A.

In addition, as shown in FIGS. 14A and 14B, when the planetary gear 71 is rotated, and the first rack gear unit 40 is moved further to the left, the planetary gear 71 passes through a position at the right end of the first rack gear unit 40, and the engaged state with the first rack gear unit 40 is released.

Figure 15A:
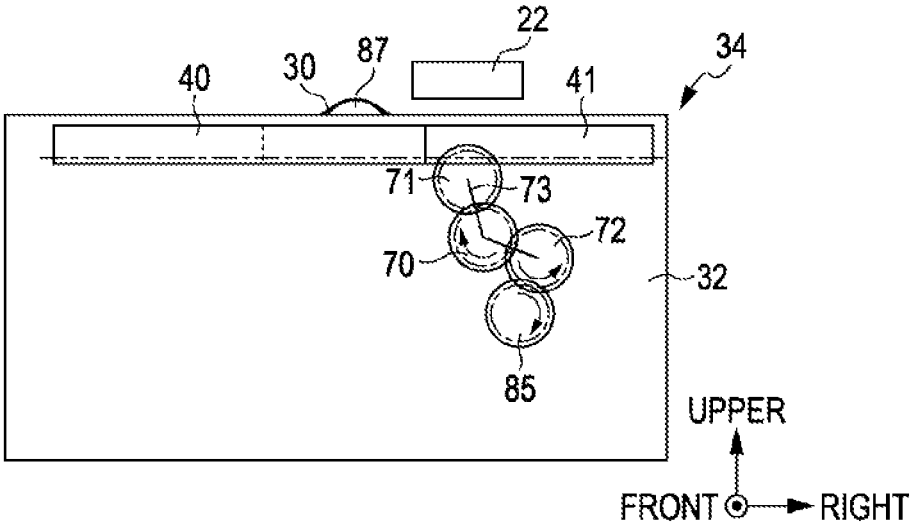
FIG. 15A is a front view which schematically illustrates the wiper unit in a state in which a planetary gear is engaged with a winding-up gear.
Figure 15B:
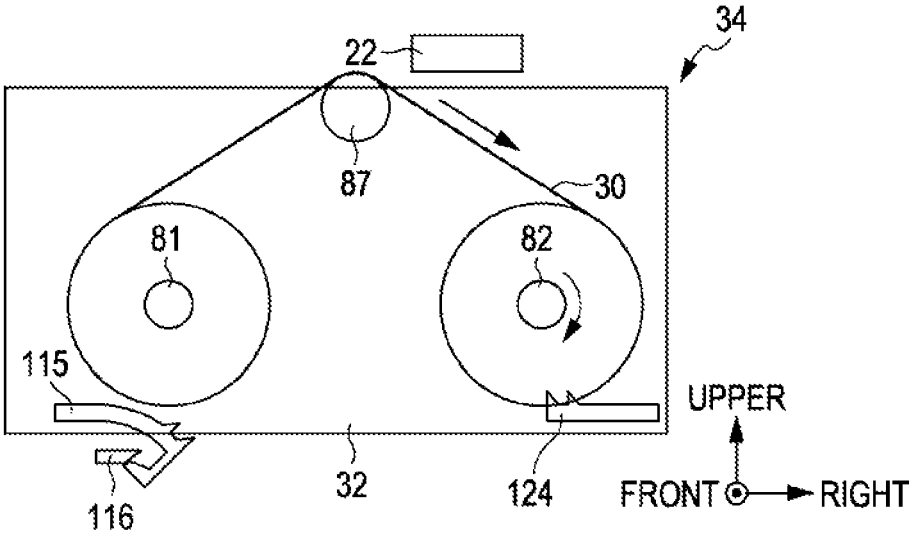
FIG. 15B is a front view which schematically illustrates an internal configuration of the wiper unit in FIG. 15A.

In addition, when the driving motor 48 continues the forward driving in a state in which the planetary gear 71 is not engaged with the first rack gear unit 40, the planetary gears 71 and 72 revolve around the sun gear 70 in the clockwise direction in FIG. 14A according to a driving force which is transmitted from the sun gear 70. As a result, as shown in FIGS. 15A and 15B, the planetary gear 72 is displaced to an engagement position with respect to the winding-up gear 85, and is engaged with the winding-up gear 85.

In addition, when the driving motor 48 continues the forward driving, the winding-up gear 85 is rotated, and the winding-up roller 82 rotates the wiping member 30 in the winding-up direction. That is, the winding-up gear 85 functions as the power transmission gear which transmits the rotational driving force which is output from the driving motor 48 to the winding-up roller 82. The wiping member 30 absorbs ink at a portion which is wound around the press roller 87. Therefore, by winding up the wiping member 30, an unused portion which does not absorb ink is moved to a portion which is wound around the press roller 87. In this manner, it is possible to reliably absorb attached ink when wiping ink from the nozzle formation surface using the wiping member 30 next time.

In addition, the protruding piece 116 which is provided in the guide frame 35 presses the ratchet 115 to the right which is the opposite direction to the movement direction of the wiper holder 32, along with the movement of the wiper holder 32. In addition, the ratchet 115 which has been elastically deformed due to the pressing operation from the protruding piece 116 release the regulation of rotation with respect to the reeling-out roller 81. That is, the protruding piece 116 functions as a regulation releasing member which is able to release the regulation of rotation with respect to the reeling-out roller 81 due to the ratchet 115. In this case, since the regulation of rotation of the reeling-out roller 81 is released by the ratchet 115, the reeling-out operation of the wiping member 30 from the reeling-out roller 81 to the winding-up roller 82 side is allowed. For this reason, the winding-up roller 82 is able to wind up the wiping member 30 which is reeled out from the reeling-out roller 81 smoothly. That is, as shown in FIGS. 15A and 15B, a position of the wiper holder 32 which is close to the left end in the movement range is set to the winding-up position of the wiping member 30.

Figure 16A:
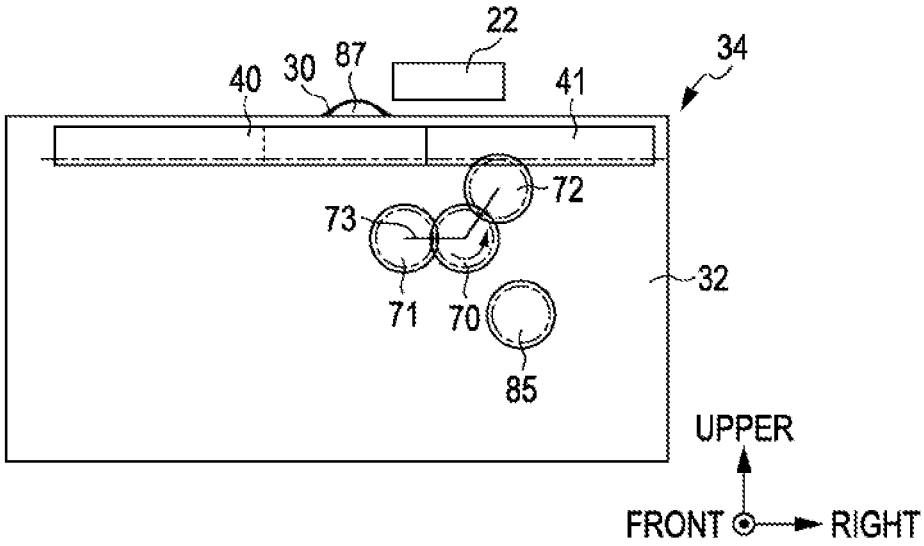
FIG. 16A is a front view which schematically illustrates the wiper unit in a state in which the planetary gear is engaged with a second rack gear unit.
Figure 16B:
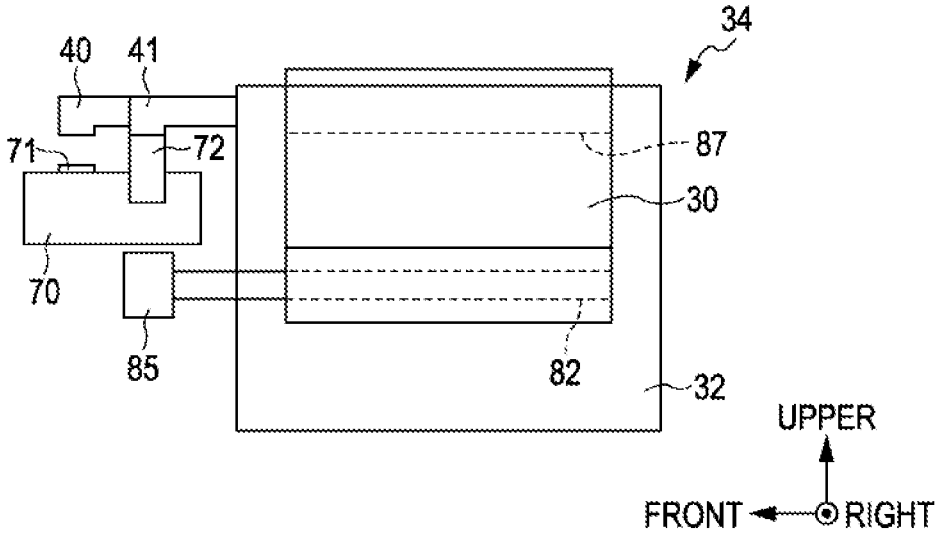
FIG. 16B is a side view which schematically illustrates the wiper unit in FIG. 16A.

In addition, when the winding-up operation of the wiping member 30 to the winding-up roller 82 is completed, the driving motor 48 drives reversely. Then, along with the reverse driving of the driving motor 48, the sun gear 70 is rotated in the counterclockwise direction in FIG. 15A. For this reason, the planetary gears 71 and 72 revolve around the sun gear 70 in the counterclockwise direction in FIG. 15A around the shaft 56 as the center. In addition, as shown in FIGS. 16A and 16B, the planetary gear 72 displaces to the engagement position with respect to the second rack gear unit 41, and is engaged with the second rack gear unit 41. That is, the planetary gear 72 functions as the second displacement gear which is engaged with the second rack gear unit 41 when the driving motor 48 drives reversely.

Figure 17A:
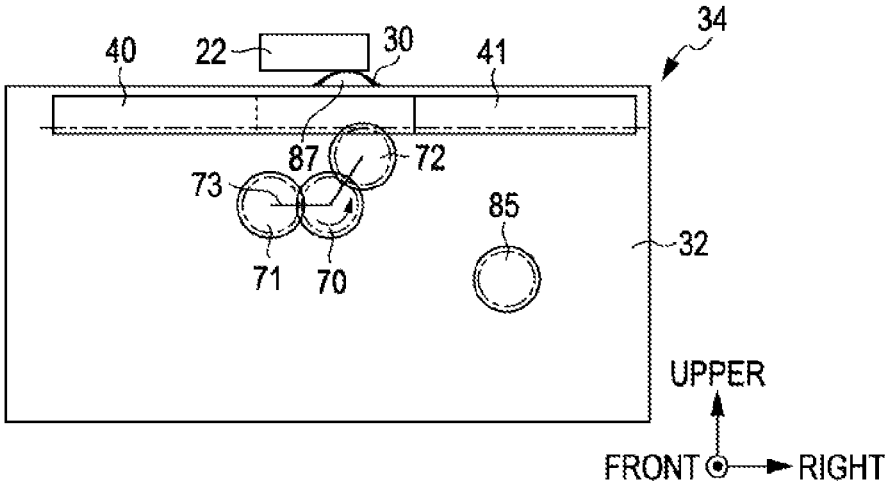
FIG. 17A is a front view which illustrates the wiper unit in a state of wiping the recording head in the return direction.
Figure 17B:
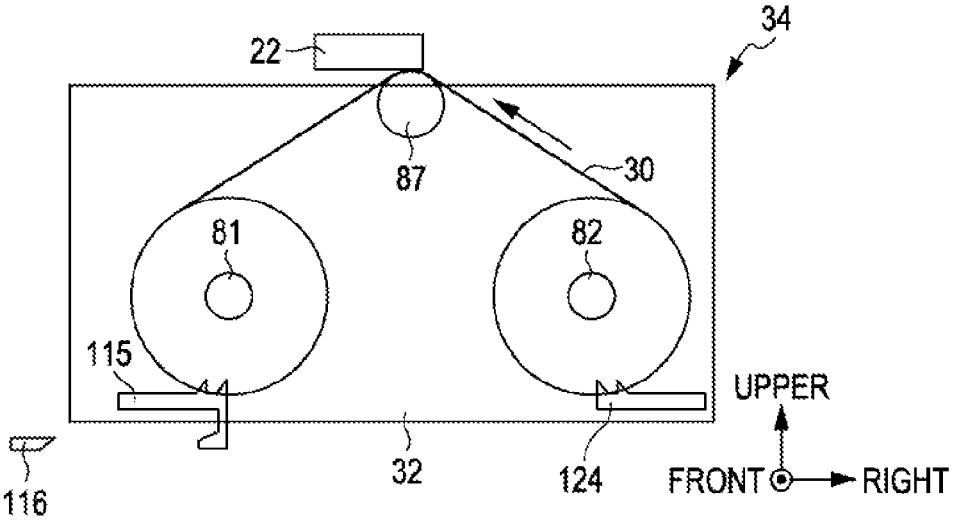
FIG. 17B is a front view which schematically illustrates an internal configuration of the wiper unit in FIG. 17A.

When the planetary gear 72 rotates in a state of being engaged with the second rack gear unit 41, the wiper holder 32 moves to the right toward the recording head 22 along with the movement of the second rack gear unit 41. In addition, as shown in FIGS. 17A and 17B, along with the movement of the wiper holder 32, ink is wiped from the nozzle formation surface when a portion of the wiping member 30 which is wound around the press roller 87 is moved to the right which is the return direction with respect to nozzle formation surface of the recording head 22, and makes a sliding contact with the recording head 22. The wiped ink is absorbed to the wiping member 30. Even in this case, similarly to returning time, since the press roller 87 is urged to vertically upward which is the direction close to the recording head 22 by the torsion bar 90, the press roller presses the wiping member 30 with respect to the nozzle formation surface of the recording head 22 according to the applied force from the torsion bar 90.

Then, due to the friction force which is caused when the wiping member 30 makes a sliding contact with the nozzle formation surface of the recording head 22, tension acts on the wiping member 30 in the direction in which the wiping member 30 is reeled out from the winding-up roller 82. Regarding this, according to the embodiment, the rotation of the winding-up roller 82 in the direction in which the wiping member 30 is reeled out is regulated by the ratchet 124. For this reason, the wiping member 30 is rarely sagged when being reeled out from the winding-up roller 82, at the time of wiping the nozzle formation surface of the recording head 22.

Figure 18:
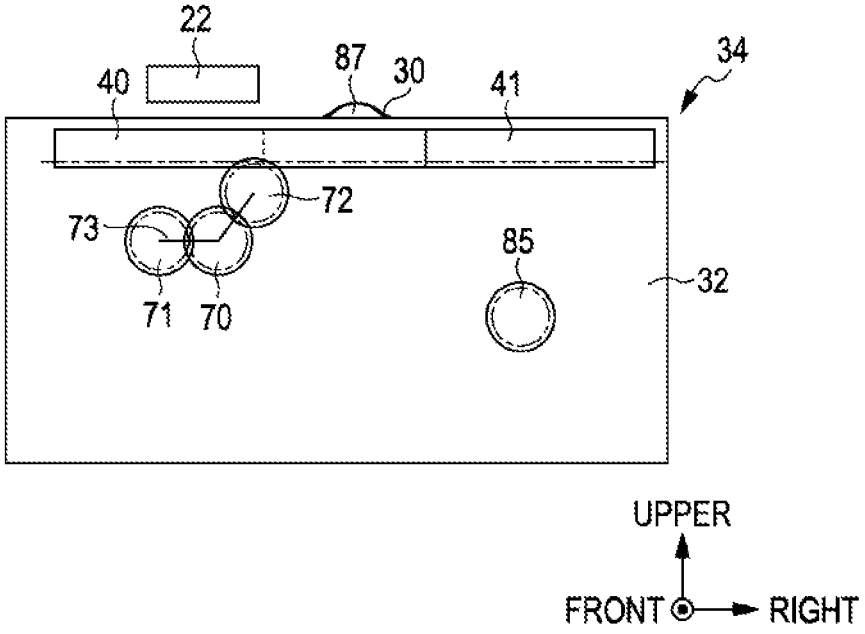
FIG. 18 is a front view which schematically illustrates the wiper unit after completing the wiping operation.

In addition, as shown in FIG. 18, when the planetary gear 72 is further rotated in a state of being engaged with respect to the second rack gear unit 41, the wiper holder 32 further moves to the right, and the press roller 87 intersects the nozzle formation surface of the recording head 22. In addition, the planetary gear 72 passes through the left end position of the second rack gear unit 41, and is released from the engaged state with respect to the second rack gear unit 41. As a result, the wiper holder 32 is arranged at the initial position as a position at which the first rack gear unit 40 is located on the circumferential path of the planetary gear 71.

Subsequently, operations when detecting a reeling-out amount of the wiping member 30 from the reeling-out roller 81 to the winding-up roller 82 will be described.

Figure 19A:
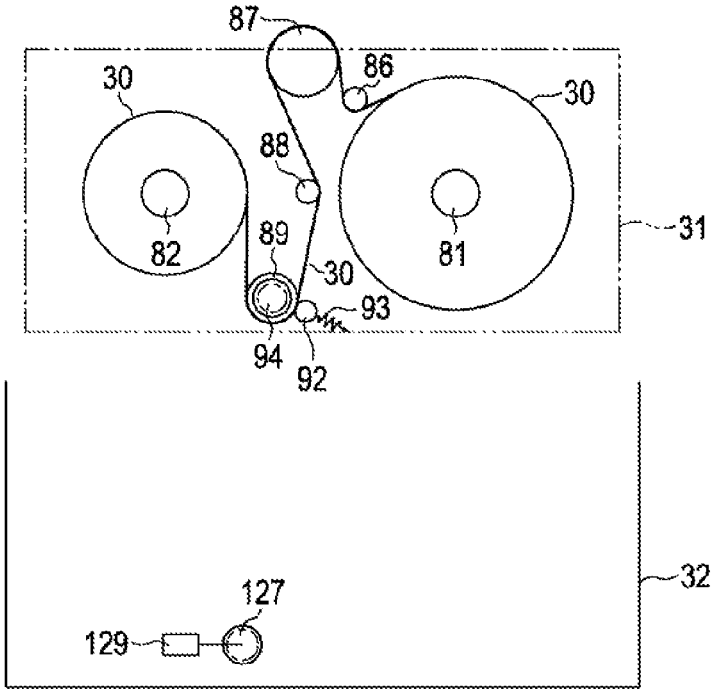
FIG. 19A is a front view which schematically illustrates a state in which the wiper cassette is taken out upward from the wiper holder.

As shown in FIG. 19A, in a state in which the mounted wiper cassette 31 is located at the vertically upper part of the wiper holder 32, the relay gear 94 which is provided in the wiper cassette 31 is arranged at a position facing the driven gear 127 which is provide at the wiper holder 32 in the vertical direction.

Figure 19B:
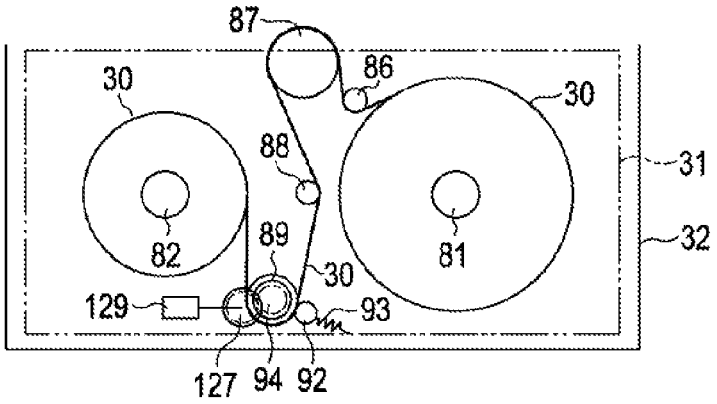
FIG. 19B is a front view which schematically illustrates a state in which the wiper cassette is mounted with respect to the wiper holder from a state illustrated in FIG. 19A.
Figure 19C:
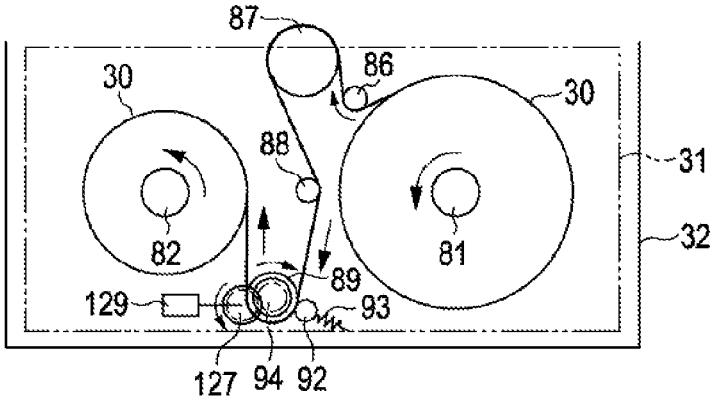
FIG. 19C is a front view which schematically illustrates a state in which the wiping member is reeled out from a state illustrated in FIG. 19B.

In addition, as shown in FIG. 19B, when the wiper cassette 31 is mounted in the wiper holder 32, the relay gear 94 is engaged with the driven gear 127 from above so as to transmit power. Subsequently, as shown in FIG. 19C, when the wiping member 30 is reeled out from the reeling-out roller 81 to the winding-up roller 82, the relay roller 89 which is wound with the wiping member 30 rotates along with the reeling-out operation of the wiping member 30. Then, a rotation amount of the relay roller 89 is transmitted to the driven gear 127 through the relay gear 94, and a rotation amount of the shaft 127*a* corresponding to the rotation amount of the relay roller 89 is detected by the rotary encoder 129 which is provided in the wiper holder 32.

Here, the rotation amount of the relay roller 89 accurately reflects the reeling-out amount of the wiping member 30 from the reeling-out roller 81 to the winding-up roller 82 without depending on the residual winding-up amount of the wiping member 30 which is wound around the reeling-out roller 81 and the winding-up roller 82. For this reason, the rotary encoder 129 is able to accurately detect the reeling-out amount of the wiping member 30 from the reeling-out roller 81 to the winding-up roller 82 through a detection of the rotation amount of the relay roller 89.

In addition, the relay roller 89 rigidly interposes the wiping member 30 between the relay roller and the interposing roller 92 which is urged by the spring member 93. For this reason, the wiping member 30 is prevented from slipping in the reeling-out direction with respect to the circumferential surface of the relay roller 89. As a result, the rotation amount of the relay roller 89 further accurately reflects the reeling-out amount of the wiping member 30 from the reeling-out roller 81 to the winding-up roller 82. Accordingly, the rotary encoder 129 is able to accurately detect the reeling-out amount of the wiping member 30.

Subsequently, operations when mounting and detaching the wiper cassette 31 with respect to the wiper holder 32 will be described.

Figure 20A:
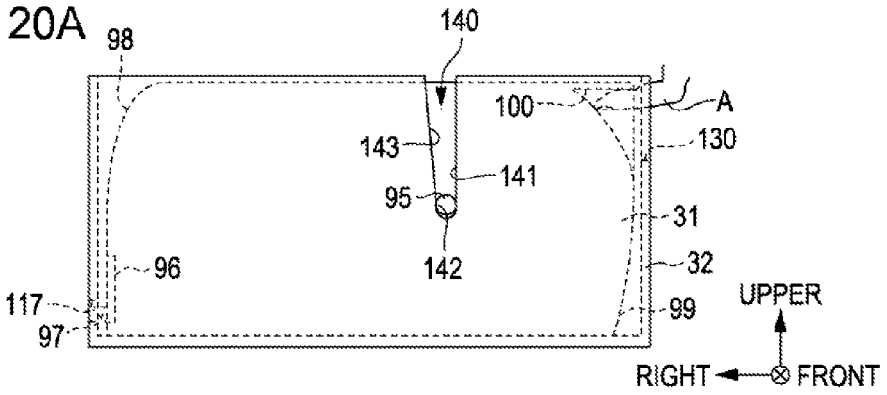
FIG. 20A is a front view which schematically illustrates a state before detaching the wiper cassette from the wiper holder.

As shown in FIG. 20A, when detaching the wiper cassette 31 from the wiper holder 32, a user inserts a fingertip A into the wiper holder 32 through the concave portion 130 of the wiper holder 32. In addition, the user lifts the hooking unit 100 of the wiper cassette 31 vertically upward in a state of hooking the fingertip A to the hooking unit 100 of the wiper cassette 31.

Figure 20B:
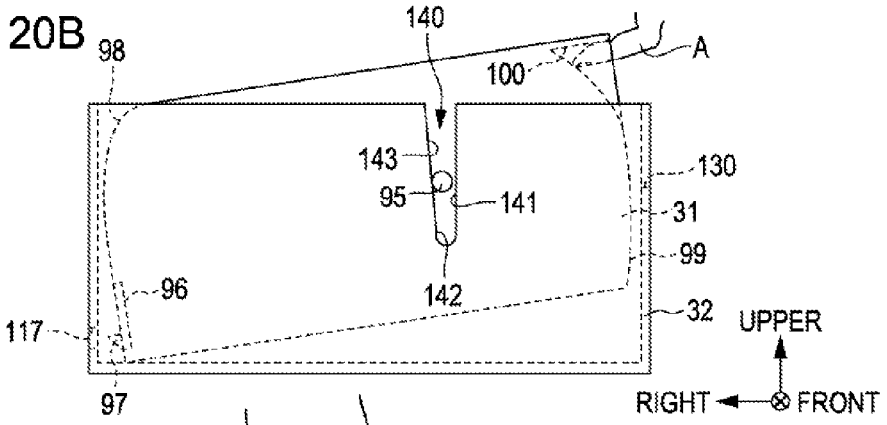
FIG. 20B is a front view which schematically illustrates a state in which the wiper cassette is tilted.

Then, as shown in FIG. 20B, the engaging protrusion 95 of the wiper cassette 31 displaces the inside of the engaging concave portion 140 of the wiper holder 32 upward. In this case, the engaging protrusion 95 makes a sliding contact with the slope 143 upward which is located at a position which is close to the side opposite to the hooking unit 100 on which a force from the fingertip A acts in the engaging concave portion 140. In addition, a portion of the wiper cassette 31 which is located at the opposite side to the hooking unit 100 in the horizontal direction which is orthogonal to the protruding direction of the engaging protrusion 95, and is close to the right end sinks downward, and is tilted around the engaging protrusion 95 while making a sliding contact with the inner base of the wiper holder 32. That is, the engaging protrusion 95 as the center of tilting of the wiper cassette 31 is in sliding contact with the slope 143 which configures a part of the inner surface of the engaging concave portion 140, and is guided to the upper direction which is the detaching direction of the wiper cassette 31. In addition, the engaging concave portion 140 functions as a guide unit which guides the engaging protrusion 95 as a guided portion to the detaching direction of the wiper cassette 31.

In addition, since the wiper cassette 31 has curved surfaces 98 and 99 at corners of a contour shape when seen in the front-back direction as the protruding direction of the engaging protrusion 95, it is possible to smoothly tilt around the engaging protrusion 95 without being interfered by the inner surface of the wiper holder 32.

In addition, when the wiper cassette 31 is tilted around the engaging protrusion 95, the locking claw 97 which is formed at a position opposite to the hooking unit 100 by interposing the engaging protrusion 95 therebetween when seen in the front-back direction as the protruding direction of the engaging protrusion 95 is separated from the hooking hole 117 of the wiper holder 32, and the wiper cassette 31 is unlocked with respect to the wiper holder 32 in the vertical direction.

Figure 20C:
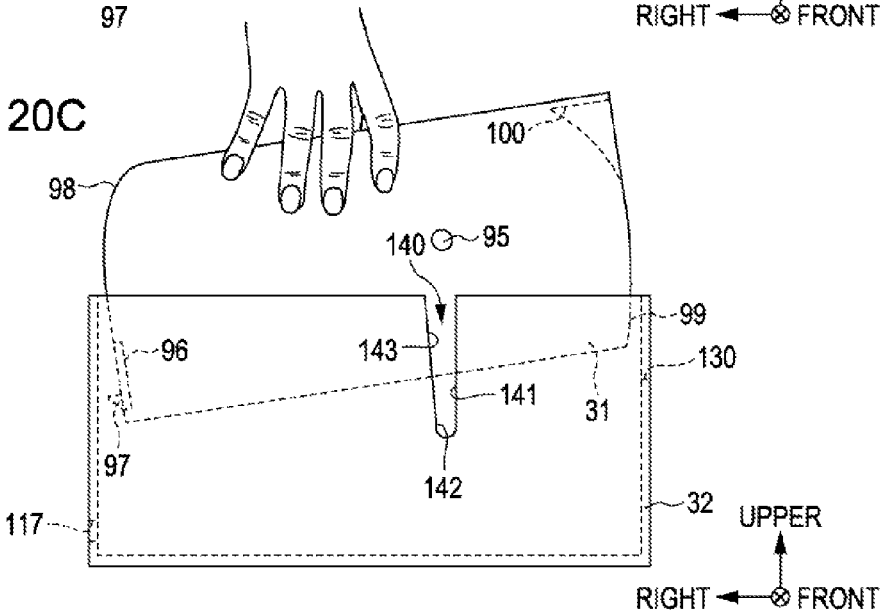
FIG. 20C is a front view which schematically illustrates a state in which the wiper cassette is detached.

Thereafter, as shown in FIG. 20C, the user grips an upper portion of the wiper cassette 31 which comes out from the wiper holder 32 along with tilting of the wiper cassette 31, and detaches the wiper cassette 31 from the wiper holder 32 vertically upward.

Figure 21A:
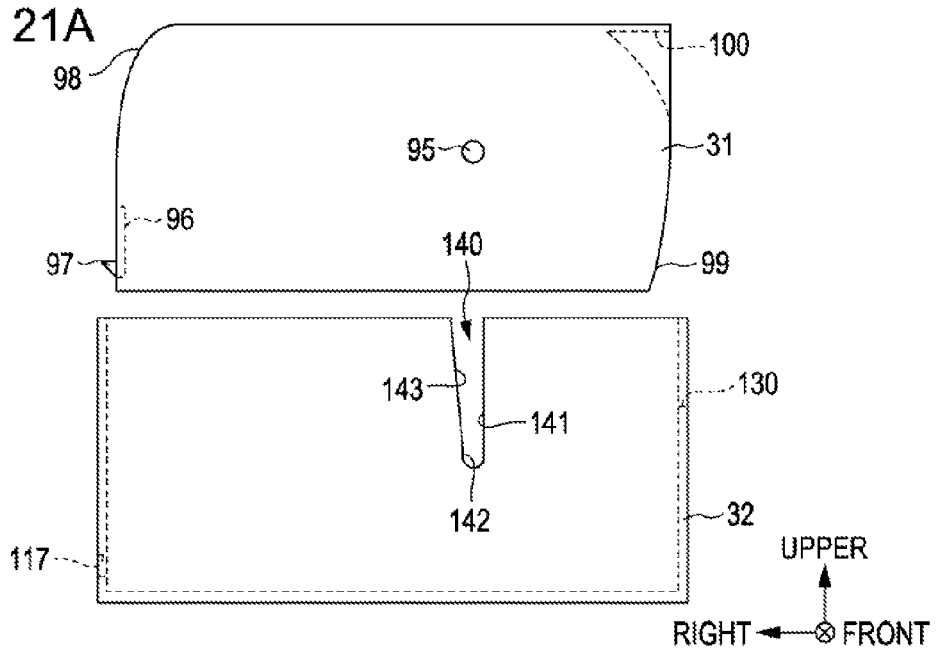
FIG. 21A is a front view which schematically illustrates a state before mounting the wiper cassette with respect to the wiper holder.

In addition, as shown in FIG. 21A, when mounting the wiper cassette 31 with respect to the wiper holder 32, the engaging protrusion 95 of the wiper cassette 31 is aligned with respect to the engaging concave portion 140 of the wiper holder 32.

Figure 21B:
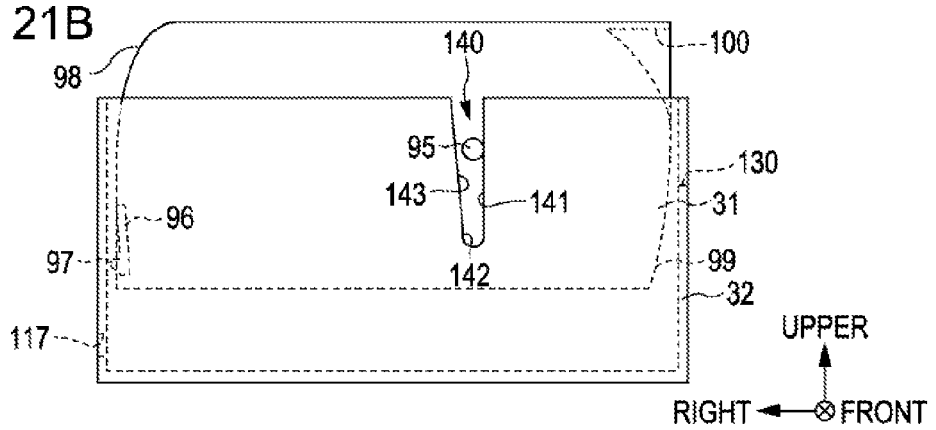
FIG. 21B is a front view which schematically illustrates a state during which the wiper cassette is being mounted with respect to the wiper holder.

Subsequently, as shown in FIG. 21B, the engaging protrusion 95 of the wiper cassette 31 is inserted into the engaging concave portion 140 of the wiper holder 32 from above when the wiper cassette 31 is displaced in the vertical direction while maintaining a horizontal posture. In this case, the wiper cassette 31 is mounted with respect to the wiper holder 32 while the engaging protrusion 95 is positioned in the horizontal direction which is orthogonal to the protruding direction thereof by the engaging concave portion 140. In addition, since the horizontal size of the upper opening in the engaging concave portion 140 is set to be slightly larger than the diameter of the engaging protrusion 95, it is possible to easily insert the engaging protrusion 95 into the engaging concave portion 140 from above. In addition, the locking claw 97 makes a sliding contact with the inner surface of the wiper holder 32 while elastically deforming the elastic piece 96 having the upper end portion as a fixed end.

Figure 21C:
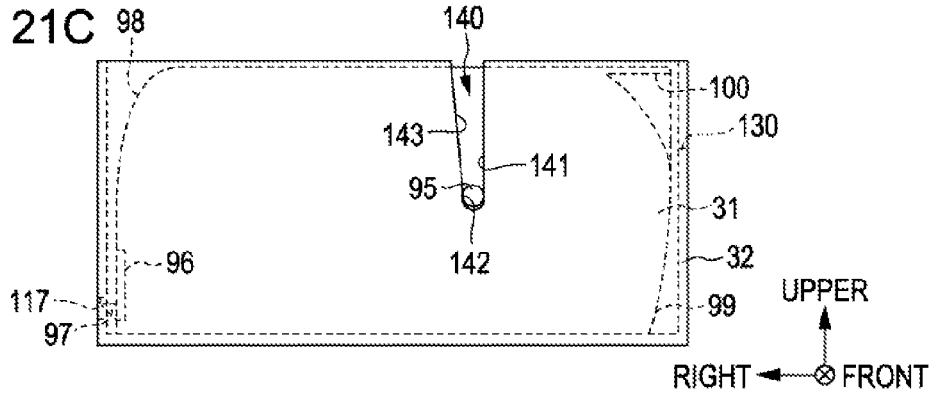
FIG. 21C is a front view which schematically illustrates a state in which the wiper cassette has been mounted with respect to the wiper holder.

Thereafter, as shown in FIG. 21C, when the engaging protrusion 95 is inserted into the lower end position as the innermost side of the engaging concave portion 140, the engaging protrusion 95 is locked from both sides by the vertical planes 141 and 142 of the engaging concave portion 140. In addition, the wiper cassette 31 is positioned in the horizontal direction with respect to the wiper holder 32. In addition, when the locking claw 97 is locked with respect to the hooking hole 117 of the wiper holder 32 according to an elastic return power of the elastic piece 96, the mounting operation of the wiper cassette 31 with respect to the wiper holder 32 is completed.

According to the embodiment, it is possible to obtain effects in below.

(1) When wiping ink by causing the wiping member 30 to make a sliding contact with the recording head 22, the rotations of the rollers 81 and 82 in the direction in which the wiping member 30 is reeled out are regulated by the ratchets 115 and 124 even if tension acts on the wiping member 30 in the direction in which the wiping member 30 is reeled out from the reeling-out roller 81, or the winding-up roller 82 by a friction force which is generated between the recording head 22 and the wiping member 30. In addition, the ratchets 115 and 124 which regulate the rotations of both rollers 81 and 82 can have lightweight configurations compared to the driving motor 48 which is used when rotationally driving both the rollers 81 and 82. For this reason, it is possible to make a light wiper holder 32 comparing to a case in which a driving motor which rotationally drives both the rollers 81 and 82 is provided in the wiper holder 32. Accordingly, it is possible to prevent the wiping member 30 from sagging when wiping ink from the recording head 22 while making the wiper holder 32 lightweight.

(2) When the ratchets 115 and 124 are engaged with the driven gears 105 and 122, it is possible to prevent the wiping member 30 from sagging when wiping ink from the recording head 22, by suppressing rotations of the rollers 81 and 82 at which tension is applied.

(3) When the protruding piece 116 releases the regulation of rotation with respect to the reeling-out roller 81 by the ratchet 115, it is possible to make the reeling-out roller 81 to rotate in the direction in which the wiping member 30 is reeled out, and winding-up of the wiping member 30 to the winding-up roller 82 is enabled. Accordingly, it is possible to wind up the wiping member 30 with respect to the winding-up roller 82 as necessary when not performing wiping, while preventing the wiping member 30 from sagging when wiping ink from the recording head 22.

(4) The protruding piece 116 releases the regulation of rotation with respect to the reeling-out roller 81 by the ratchet 115 along with a movement of the ratchet 115 when performing wiping. For this reason, it is not necessary to perform a special operation for releasing the regulation of rotation with respect to the reeling-out roller 81 by the ratchet 115, and it is possible to wind up the wiping member 30 with respect to the winding-up roller 82 by reeling out the wiping member 30 from the reeling-out roller 81 as necessary when not performing the wiping.

(5) The driving motor 48 not only functions as a driving source when moving the wiper holder 32 in the wiping direction, but also functions as a driving source when winding the wiping member 30 around the winding-up roller 82. Accordingly, it is possible to improve assembly efficiency of the entire unit along with reduction in the number of components.

(6) When the sun gear 70 is rotationally driven in both the forward and reverse directions according to the power which is transmitted from the driving motor 48, it is possible to make the wiping member 30 which is mounted in the wiper holder 32 wipe ink by being relatively moved in both directions with respect to the recording head 22, when the rotational driving force is transmitted to the rack gear units 40 and 41 through the planetary gears 71 and 72 which correspond thereto respectively.

(7) Whether or not the planetary gear 72 can be engaged with the winding-up gear 85 is varied depending on the movement operation of the wiper holder 32 in the wiping direction. For this reason, when the wiper holder 32 is moved in the wiping direction while enabling the wiping member 30 to be wound around the winding-up roller 82, it is possible to easily realize a configuration in which the wiping member 30 is not erroneously wound around the winding-up roller 82.

(8) The planetary gears 71 and 72 revolves along the circumferential direction around the shaft 56 as the rotation shaft of the sun gear 70 in the direction in which the planetary gears are engaged with the rack gear units 40 and 41 to which the planetary gears correspond, respectively, according to the driving force which is transmitted from the sun gear 70, when the driving motor 48 drives forwardly and reversely. For this reason, when the power which is output from the driving motor 48 is transmitted to the wiper holder 32, the planetary gears 71 and 72, and the rack gear units 40 and 41 of the wiper holder 32 are reliably engaged with each other. Accordingly, when the wiping member 30 wipes ink by performing a relative movement in both directions with respect to the recording head 22, it is possible to perform a stable wiping operation at the time of moving in the wiping direction.

(9) The rotary encoder 129 detects a reeling-out amount of the wiping member 30 from the reeling-out roller 81 to the winding-up roller 82 which is wound around the relay roller 89, based on a detection result of the rotation amount of the relay roller 89. For this reason, it is possible to accurately detect the reeling-out amount of the wiping member 30 from the reeling-out roller 81 to the winding-up roller 82 without being affected by the size of the roll diameter of the wiping member 30 which is wound around both the rollers 81 and 82. Accordingly, it is possible to prevent a portion of the wiping member 30 which absorbs ink from attaching to the recording head 22, while suppressing waste of wiping member 30.

(10) Since the rotary encoder 129 is provided in the wiper holder 32 to and from which the wiper cassette 31 is attached and detached, a common rotary encoder 129 is used with respect to the wiper cassette 31 before detaching and after attaching. That is, since it is not necessary to provide the rotary encoder 129 for each wiper cassette 31 to be attached and detached, it is possible to contribute to reduction in the number of components.

(11) The wiping member 30 is interposed between the interposing roller 92 and the relay roller 89. For this reason, the relay roller 89 which is interposing the wiping member 30 with the interposing roller is further reliably rotated along with the reeling-out of the wiping member 30 from the reeling-out roller 81 to the winding-up roller 82. Accordingly, the rotary encoder 129 is able to accurately detect the reeling-out amount of the wiping member 30 through the detection of the rotation amount of the relay roller 89.

(12) The wiping member 30 is rigidly interposed between the interposing roller 92 and the relay roller 89 according to the applied force which acts on the interposing roller 92 from the spring member 93. For this reason, the slip of the wiping member 30 with respect to the relay roller 89 in the reeling-out direction of the wiping member 30 is suppressed. Accordingly, the rotary encoder 129 can further accurately detect the rotation amount of the relay roller 89 as the reeling-out amount of the wiping member 30.

(13) When the wiping member 30 which is mounted in the wiper cassette 31 wipes the recording head 22, the displacement of the wiper cassette 31 is regulated by the locking claw 97 even when the wiper cassette 31 is to be displaced in the direction in which the wiper cassette 31 is separated from the wiper holder 32 due to a reaction force which acts from the recording head 22. On the other hand, when the wiper cassette 31 is detached from the wiper holder 32, the locking state with respect to the wiper holder 32 due to the locking claw 97 is released along with tilting of the wiper cassette 31. For this reason, the detaching operation of the wiper cassette 31 from the wiper holder 32 is not hindered by the locking claw 97. Accordingly, it is possible to easily detach the wiper cassette 31 from the wiper holder 32.

(14) Since it is possible to apply an external force toward the detaching direction with respect to the hooking unit 100 of the wiper cassette 31 which is exposed to the outside through the concave portion 130 of the wiper holder 32, even when the wiper cassette 31 is in a state of being mounted in the wiper holder 32 by being engaged therewith, it is possible to easily detach the wiper cassette 31 from the wiper holder 32.

(15) Since the wiper cassette 31 is allowed to tilt in the wiper holder 32 when an external force is applied to the hooking unit 100, it is possible to expose a portion of the wiper cassette 31 which can be gripped from the wiper holder 32, by tilting the wiper cassette 31 at the time of detaching. Accordingly, it is possible for the user to easily detach the wiper cassette 31 from the wiper holder 32 by gripping the portion in the wiper cassette 31 which comes out from the wiper holder 32.

(16) When the external force is applied to the hooking unit 100, the engaging protrusion 95 as the center of tilting of the wiper cassette 31 is guided to the detaching direction of the wiper cassette 31 due to the engaging concave portion 140 of the wiper holder 32. For this reason, it is possible to smoothly detach the wiper cassette 31 while suppressing excessive tilting of the wiper cassette 31, since a tilting posture of the wiper cassette 31 is stable.

(17) It is possible to make the wiper cassette 31 be stably tilted using the engaging protrusion 95 as the center of tilting, and to easily realize a configuration in which the center of tilting of the wiper cassette 31 is smoothly displaced in the detaching direction of the wiper cassette 31, when the engaging protrusion 95 which is provided in the wiper cassette 31 is in concave-convex engagement with the engaging concave portion 140 which is provided in the wiper holder 32.

In addition, the above described embodiment can be modified as separate embodiments as follows.

In the above described embodiment, the regulation releasing member which is able to release the regulation of rotation of the reeling-out roller 81 due to the ratchet 115 is not necessarily provided in the guide frame 35, and an arbitrary member can be provided if it is a member which is able to relatively move in the movement direction with respect to the wiper holder 32 when the wiper holder 32 is moved. In addition, the regulation releasing member is not limited to a configuration in which the ratchet 115 is pressed in the direction which is opposite to the movement direction of the wiper holder 32 along with the movement of the wiper holder 32, and it is possible to adopt an arbitrary configuration, if it is configured to be able to release the regulation of rotation of the reeling-out roller 81 due to the ratchet 115. In addition, the target of the regulation releasing member is not limited to the ratchet 115 which regulates the rotation of the reeling-out roller 81, and may be the ratchet 124 which releases the regulation of rotation of the winding-up roller 82.

In the above described embodiment, the wiper holder 32 may have a configuration in which ink is wiped from the nozzle formation surface when the wiper holder 32 relatively moves in a single direction with respect to the recording head 22. In this case, it may also have a configuration in which only one roller between the reeling-out roller 81 and the winding-up roller 82 from which the wiping member 30 is reeled out when wiping ink from the recording head 22 may be provided with the ratchet.

The above described embodiment may also have a configuration in which at least one ratchet between the ratchet 115 which regulates the rotation of the reeling-out roller 81 and the ratchet 124 which regulates rotation of the winding-up roller 82 regulates the rollers to which the ratchets correspond respectively, so as not to rotate in the winding-up direction of the wiping member 30.

The above described embodiment may also have a configuration in which the winding-up gear 85 is located on the movement path of the planetary gear 72 which goes along the circumferential direction, around the shaft 56 as the rotation shaft of the sun gear 70 in a state in which the wiper holder 32 is located at a position which is separated from the winding-up position at which the wiper holder 32 winds the wiping member 30 around the winding-up roller 82.

The above described embodiment may also have a configuration in which the planetary gear 71 is engaged with the first rack gear unit 40 so as to transmit power from the front side in the rotation direction of the sun gear 70, when the driving motor 48 drives forwardly. In addition, it may also have a configuration in which the planetary gear 72 is engaged with the second rack gear unit 41 so as to transmit power from the front side in the rotation direction of the sun gear 70, when the driving motor 48 drives reversely.

In the above described embodiment, the rack gear unit with which the planetary gear 71 is engaged at the time of forward driving of the driving motor 48 may also function as the rack gear unit with which the planetary gear 72 is engaged at the time of reverse driving of the driving motor 48.

The above described embodiment may also have a configuration in which the urging member which urges the interposing roller 92 in the direction in which the interposing roller is caused to approach the relay roller 89 is omitted.

The above described embodiment may also have a configuration in which the interposing roller 92 which interposes the wiping member 30 with the relay roller 89 is omitted.

In the above described embodiment, the rotary encoder 129 which measures the rotation amount of the relay roller 89 may be mounted in the wiper cassette 31.

The above described embodiment may also have a configuration in which the rotary encoder 129 detects the reeling-out amount of the wiping member 30 from the reeling-out roller 81 to the winding-up roller 82 based on the detection result of the rotation amount of the press roller 87, or the tension rollers 86 and 88.

In the above described embodiment, the rotation amount detection member which detects the rotation amount of the roller around which the wiping member 30 is wound is not limited to the rotary encoder, and it is possible to adopt a member with an arbitrary detection method, if it has a configuration which can detect the rotation amount of the roller.

In the above described embodiment, the locking claw 97 which locks the wiper cassette 31 with respect to the wiper holder 32 may be provided at a position on the hooking unit 100 side when seen from the engaging protrusion 95 of the wiper cassette 31. In addition, it may have a configuration in which the locking claw 97 is omitted.

In the above described embodiment, the engaging protrusion may be provided in the wiper holder 32, and the engaging concave portion which is engaged with the engaging protrusion may be provide in the wiper cassette 31.

In the above described embodiment, the curved surfaces 98 and 99 of the wiper cassette 31 may have shapes which are curved in substantially arc shapes which are concaves toward the outside of the wiper cassette 31. In addition, an interference avoiding shape for avoiding the interference from the wiper holder 32 when the wiper cassette 31 is tilted is not limited to the curved shape, and it may adopt an arbitrary shape if it is a shape which is evacuated inward compared to other portions on the outer surface of the wiper cassette 31.

In the above described embodiment, as the power point operation unit which applies the external force to the wiper cassette 31 toward the detaching direction from the wiper holder 32, a protrusion unit in which a user's fingertip is hooked may be provided, or a rough face portion at which the a fingertip of a user makes a frictional engagement may be provided.

In the above described embodiment, a liquid ejecting apparatus has been embodied in the ink jet printer 11, however, it may be embodied in a liquid ejecting apparatus in which other liquid than ink is jet or ejected. The liquid ejecting apparatus can be carried over to various liquid ejecting apparatuses which include a liquid ejecting head ejecting minute amount of liquid droplets, or the like. In addition, the liquid droplets mean a state of liquid which is ejected from the liquid ejecting apparatus, and includes a granular shape, a tear shape, or a thread shape leaving a trail. In addition, the liquid here may be a material which can be ejected by the liquid ejecting apparatus. For example, the material may include a material in a state of liquid phase, materials which flow such as a liquid body having high viscosity, or low viscosity, sol, gel water, and inorganic solvent, organic solvent, liquid, liquid resin, liquid metal (metallic melt) other than that, or materials in which particles of a functional material which is formed of a solid body such as a pigment or metal particles are melted, diffuse, or mixed in a solvent, not only as liquid as a state of the material. In addition, as a representative example of the liquid, the ink, liquid crystal, or the like can be exemplified as described in the above embodiments. Here, the ink includes general water-based ink and oil-based ink, and a variety of liquid compositions such as gel ink, hot-melt ink, or the like. As a specific example of the liquid ejecting apparatus, there is a liquid ejecting apparatus which ejects liquid including a material such as an electrode material, or a color material which is used when manufacturing, for example, a liquid display, an EL (electroluminescence) display, a plane emission display, a color filter, or the like, in form of dispersion, or dissolution. Alternatively, they may be a liquid ejecting apparatus which ejects a biological organic substance which is used when manufacturing a biochip, a liquid ejecting apparatus which ejects liquid as a sample which is used as precision pipette, a textile printing device, a micro-dispenser, or the like. Further, the liquid ejecting apparatus may be a liquid ejecting apparatus which ejects a lubricant to a precision machine such as a clock, a camera, or the like, using a pinpoint, a liquid ejecting apparatus which ejects transparent resin liquid such as UV curable resin for forming a micro bulls-eye (optical lens) which is used in an optical communication element, or the like, onto a substrate, and a liquid ejecting apparatus which ejects etching liquid such as acid or alkali for etching a substrate or the like. In addition, it is possible to apply the invention to any one of these liquid ejecting apparatuses.

What is claimed is:

1. A wiper cassette comprising:

a housing;

a wiping member which wipes a liquid adhered to a liquid ejecting head which ejects the liquid;

a feed roller around which an end of the wiping member is wound in a longitudinal direction; and a winding roller around which other end of the wiping member is wound in the longitudinal direction, wherein the wiper cassette is mounted so as to be freely detachable and attachable into a wiper holder, wherein the wiper cassette further comprises:

a winding gear supported by the winding roller at an outside of the housing; and a rotation gear which rotates corresponding to movement of the wiping member, and wherein the rotation gear is positioned below the winding gear in a mounted state in which the wiper cassette is mounted into the wiper holder.

2. The wiper cassette according to claim 1, further comprising:

a relay roller which is rotated by feeding the wiping member from the feed roller to the winding roller; and the rotation gear is supported by the relay roller so as to be capable of meshing with a detection gear, where the detection gear is included in a rotation amount detection unit which is provided in the wiper holder in order to detect a feeding amount of the wiping member.

3. The wiper cassette according to claim 1, further comprising:

a power point acting portion on which a load acts in a removal direction when the wiper cassette is removed from the wiper holder, and wherein the power point acting portion is positioned closer to the removal direction side than the winding gear in a mounted state in which the wiper cassette is mounted into the wiper holder.

4. The wiper cassette according to claim 3, wherein the feed roller is positioned between the winding roller and the power point acting portion in an axial intersection direction, which is the direction between the feed roller and the winding roller.

5. The wiper cassette according to claim 3, wherein the power point acting portion is provided to extend in a direction intersecting the removal direction.

6. The wiper cassette according to claim 3, further comprising:

a locking portion which is locked to the wiper holder in a mounted state, wherein the winding roller is positioned between the power point acting portion and the locking portion in a direction intersecting an axial direction of the winding roller.

7. The wiper cassette according to claim 1, wherein the wiping member includes a contact portion protruding from the housing toward a wiping region to wipe the liquid, and wherein the winding gear is positioned below the wiping region in the mounted state.

8. The wiper cassette according to claim 1, wherein the rotation gear is disposed on an opposite outside of the housing from the winding gear.

9. The wiper cassette according to claim 8, wherein the wiping member includes a contact portion protruding from the housing toward a wiping region to wipe the liquid, and the rotation gear is located so as not to protrude from the housing toward the wiping region and located so as not to protrude from the housing in the mounting direction.

10. The wiper cassette according to claim 1, wherein the winding roller has a shaft axis extended in an extending direction intersecting a mounting direction when the wiper cassette is mounted into the wiper holder, the winding gear rotates corresponding to movement of the winding roller around the shaft axis, and the rotation gear rotates around a rotation axis along the extending direction.

11. A wiper unit comprising a wiper cassette and a wiper holder, the wiper cassette comprising:

a housing;

a wiping member which wipes a liquid adhered to a liquid ejecting head which ejects the liquid;

a feed roller around which an end of the wiping member is wound in a longitudinal direction; and a winding roller around which other end of the wiping member is wound in the longitudinal direction, wherein the wiper cassette is mounted so as to be freely detachable and attachable into a wiper holder, wherein the wiper cassette further comprises a winding gear supported by the winding roller at an outside of the housing; and a rotation gear which rotates corresponding to movement of the wiping member, and wherein the rotation gear is positioned below the winding gear in a mounted state in which the wiper cassette is mounted into the wiper holder.

12. The wiper unit according to claim 11, wherein, in a mounted state, the wiper holder is movable in relation to the liquid ejecting head in a state in which the wiping member is caused to abut the liquid ejecting head.

13. The wiper unit according to claim 11, wherein the rotation gear is located so as to be capable of meshing with a detection gear included in a rotation amount detection unit which is provided in the wiper holder in order to detect a feeding amount of the wiping member, the detection gear is positioned below the rotation gear in a mounted state in which the wiper cassette is mounted into the wiper holder.

14. A liquid ejecting apparatus comprising a wiper unit and a liquid ejecting head, the wiper unit comprising a wiper cassette and a wiper holder, the wiper cassette comprising:

a housing;

a wiping member which wipes a liquid adhered to a liquid ejecting head which ejects the liquid;

a feed roller around which an end of the wiping member is wound in a longitudinal direction; and a winding roller around which other end of the wiping member is wound in the longitudinal direction, wherein the wiper cassette is mounted so as to be freely detachable and attachable into a wiper holder, wherein the wiper cassette further comprises a winding gear supported by the winding roller at an outside of the housing; and a rotation gear which rotates corresponding to movement of the wiping member, and wherein the rotation gear is positioned below the winding gear in a mounted state in which the wiper cassette is mounted into the wiper holder.

15. The liquid ejecting apparatus according to claim 14, wherein the liquid ejecting head includes a plurality of nozzles provided in a line, and wherein the winding roller has a shaft axis extended in an extending direction along the line in the mounted state.

* * * * *